US010532573B2

(12) United States Patent
Watanabe

(10) Patent No.: US 10,532,573 B2
(45) Date of Patent: Jan. 14, 2020

(54) IMAGE FORMING APPARATUS AND IMAGE FORMING METHOD

(71) Applicant: FUJIFILM Corporation, Tokyo (JP)

(72) Inventor: Hiroki Watanabe, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 16/239,543

(22) Filed: Jan. 4, 2019

(65) Prior Publication Data

US 2019/0134982 A1 May 9, 2019

Related U.S. Application Data

(63) Continuation of application No. PCT/JP2017/022893, filed on Jun. 21, 2017.

(30) Foreign Application Priority Data

Jul. 12, 2016 (JP) ..... 2016-137762

(51) Int. Cl.
*B41J 3/407* (2006.01)
*B41J 2/14* (2006.01)
*D06P 5/30* (2006.01)

(52) U.S. Cl.
CPC ..... *B41J 2/14451* (2013.01); *D06P 5/30* (2013.01)

(58) Field of Classification Search
CPC ..... B41J 2/14451; B41J 3/4078; B41J 15/16; B41J 2/01; D06P 5/30
See application file for complete search history.

(56) References Cited

U.S. PATENT DOCUMENTS 9,114,636 B2 8/2015 Hacker et al.
2003/0030686 A1* 2/2003 Abe ..... B41J 3/4078 347/16

(Continued)

FOREIGN PATENT DOCUMENTS

EP 2769849 8/2014
JP H11300948 11/1999

(Continued)

OTHER PUBLICATIONS

"International Search Report (Form PCT/ISA/210) of PCT/JP2017/022893," dated Aug. 22, 2017, with English translation thereof, pp. 1-5.

(Continued)

*Primary Examiner* — Sharon A. Polk
(74) *Attorney, Agent, or Firm* — JCIPRNET

(57) ABSTRACT

There are provided an image forming apparatus and an image forming method in which the deformation of an image caused by the deformation of a medium is suppressed in the image formation on a medium to which tension is applied. The image forming apparatus includes an image forming liquid-application amount-information acquisition unit that acquires information about the amount of applied image forming liquid, a tension-information acquisition unit that acquires information about tension applied to a medium, an elastic modulus acquisition unit that acquires an elastic modulus of the medium calculated using the information about the amount of applied image forming liquid, a medium deformation amount-calculation unit that calculates the amount of deformation of the medium using tension information and the elastic modulus, and an image conversion section that converts the image data into converted image data, which represents a converted image to be formed on the medium in a state where the tension is applied. The image forming apparatus forms an image on the medium, to (Continued)

which the tension is applied, on the basis of the converted image data.

17 Claims, 19 Drawing Sheets

(56) References Cited

U.S. PATENT DOCUMENTS

| | | | | |
|---|---|---|---|---|
| 2013/0340484 | A1 | 12/2013 | Turner | |
| 2017/0266956 | A1* | 9/2017 | Ueda | B41J 11/008 |

FOREIGN PATENT DOCUMENTS

| | | |
|---|---|---|
| JP | 2000290882 | 10/2000 |
| JP | 2004291461 | 10/2004 |
| JP | 2005014504 | 1/2005 |
| JP | 2010082935 | 4/2010 |
| JP | 2011183653 | 9/2011 |
| JP | 2015009555 | 1/2015 |

OTHER PUBLICATIONS

"Written Opinion of the International Searching Authority (Form PCT/ISA/237) of PCT/JP2017/022893," dated Aug. 22, 2017, with English translation thereof, pp. 1-9.

Yutaka Yumiya, "Study on aim accuracy of rotogravure printing machine," Monthly CONVERTECH, Converting Technical Institute, Jan. 2004, with English abstract, pp. 1-4.

"Search Report of Europe Counterpart Application", dated Jun. 28, 2019, p. 1-p. 8.

* cited by examiner

IMAGE FORMING APPARATUS AND IMAGE FORMING METHOD

CROSS-REFERENCE TO RELATED APPLICATIONS

The present application is a Continuation of PCT International Application No. PCT/JP2017/022893 filed on Jun. 21, 2017 claiming priority under 35 U.S.C § 119(a) to Japanese Patent Application No. 2016-137762 filed on Jul. 12, 2016. Each of the above applications is hereby expressly incorporated by reference, in their entirety, into the present application.

BACKGROUND OF THE INVENTION

1. Field of the Invention

The present invention relates to an image forming apparatus and an image forming method, and more particularly, to a technique for forming an image on a medium that is deformed due to the application of tension.

2. Description of the Related Art

An ink jet recording apparatus is known as an image forming apparatus that forms an image on a medium, such as paper or a film. The ink jet recording apparatus is also used to form an image on a medium, which is deformed at the time of application of tension, such as a fabric.

In a case in which an image is formed on a medium, which is deformed at the time of application of tension, in a state where tension is applied to the medium, there is a problem that the formed image is different from a planned image in a case in which the tension is removed after the formation of the image.

JP2004-291461A discloses an image forming apparatus that forms an image on a medium supported in a state where the medium is deformed. The image forming apparatus disclosed in JP2004-291461A forms an image, which has a desired size at the time of use of a medium, on the medium by jetting ink to the medium, which is supported in a state where the medium is deformed, on the basis of expansion/contraction printing image data that is made to expand or contract according to a ratio of expansion/contraction of the medium.

The term of "image forming apparatus" disclosed in this specification corresponds to the term of "printing apparatus" disclosed in JP2004-291461A. Further, the term of "medium" disclosed in this specification corresponds to the term of "printing medium" disclosed in JP2004-291461A.

JP1999-300948A (JP-H11-300948A) discloses an image forming apparatus that forms an image on a medium which is deformed in a case in which tension is applied. The image forming apparatus disclosed in JP1999-300948A (JP-H11-300948A) forms an image on a medium on the basis of image data that is corrected according to the deformation of a medium.

The term of "image forming apparatus" disclosed in this specification corresponds to the term of "printing apparatus" disclosed in JP1999-300948A (JP-H11-300948A). Further, the term of "medium" disclosed in this specification corresponds to the term of "recording medium" or the term of "fabric" disclosed in JP1999-300948A (JP-H11-300948A). Furthermore, the term of "deformation of medium" disclosed in this specification corresponds to the term of "distortion of a medium" disclosed in JP1999-300948A (JP-H11-300948A).

"Monthly CONVERTECH, Converting Technical Institute, January 2004 issue, YUTAKA YUMIYA, 'Special issue, gravure printing and environmental countermeasure', 'Study on aim accuracy of rotogravure printing machine'" discloses a relationship between tension that is applied to a medium and the amount of deformation of a medium in a rotogravure printing machine. Specifically, a relationship among the amount of deformation of a medium with respect to a product print pitch, the tension applied to a medium, the cross-sectional area of a medium, and the Young's modulus of a medium is disclosed as "the amount of deformation of medium with respect to product print pitch=tension applied to medium×product print pitch/(cross-sectional area of medium×Young's modulus of medium)".

The unit of the product print pitch and the unit of the amount of deformation of a medium with respect to a product print pitch are millimeter. The unit of the tension applied to a medium is newton. The unit of the cross-sectional area of a medium is square meter. The unit of the Young's modulus of a medium is newton per millimeter. Further, the term of "the amount of deformation of a medium" disclosed in this specification corresponds to the term of "the stretched length of a medium" disclosed in "Monthly CONVERTECH, Converting Technical Institute, January 2004 issue, YUTAKA YUMIYA, 'Special issue, gravure printing and environmental countermeasure', 'Study on aim accuracy of rotogravure printing machine'".

SUMMARY OF THE INVENTION

The amount of deformation of a medium in a case in which constant tension is applied to the medium is changed according to the amount of ink applied to the medium. However, in the image forming apparatus disclosed in JP2004-291461A, image data is made to expand or contract according to the ratio of expansion/contraction of the medium to generate expansion/contraction printing image data. Accordingly, if the amount of deformation of a medium is changed in a case in which ink is applied to the medium, it is difficult to form an image that has a desired size at the time of use of the medium.

In the image forming apparatus disclosed in JP1999-300948A (JP-H11-300948A), image data is corrected according to the amount of deformation of a medium. Accordingly, if the amount of deformation of a medium is changed in a case in which ink is applied to the medium, it is difficult to appropriately correct image data.

The amount of deformation of a medium can be estimated on the basis of description of "Monthly CONVERTECH, Converting Technical Institute, January 2004 issue, YUTAKA YUMIYA, 'Special issue, gravure printing and environmental countermeasure', 'Study on aim accuracy of rotogravure printing machine'". However, the amount of deformation of a medium to which ink is applied is not disclosed in "Monthly CONVERTECH, Converting Technical Institute, January 2004 issue, YUTAKA YUMIYA, 'Special issue, gravure printing and environmental countermeasure', 'Study on aim accuracy of rotogravure printing machine'". Further, the use of the amount of deformation of a medium during the formation of an image is not specifically described in "Monthly CONVERTECH, Converting Technical Institute, January 2004 issue, YUTAKA YUMIYA, 'Special issue, gravure printing and environmental countermeasure', 'Study on aim accuracy of rotogravure printing machine'".

A fabric is described in this specification as a medium that is used in the ink jet recording apparatus and is deformed in a case in which tension is applied. However, image formation using a medium that is deformed in a case in which tension is applied, that is, image formation in which the deformation of an image caused by the deformation of a medium causes a problem causes the same problems even in image formation in which a medium other than a fabric is used.

The invention has been made in consideration of the circumstances, and an object of the invention is to provide an image forming apparatus and an image forming method in which the deformation of an image caused by the deformation of a medium is suppressed in the image formation on a medium to which tension is applied.

The following aspects of the invention are provided to achieve the object.

An image forming apparatus of a first aspect comprises: an image forming unit that forms an image on a medium with image forming liquid including at least ink; a tension applying section that applies tension to the medium; a transport unit that allows the medium to which the tension is applied by the tension applying section and the image forming unit to be transported relative to each other; an image data acquisition section that acquires image data; an image forming liquid-application amount-information acquisition unit acquiring image forming liquid-application amount-information that is information about the amount of the applied image forming liquid calculated on the basis of the image data acquired by the image data acquisition section; a tension-information acquisition unit acquiring tension information that is information about the tension applied to the medium by the tension applying section; an elastic modulus acquisition unit that acquires an elastic modulus of the medium to which the image forming liquid is applied, the elastic modulus of the medium being calculated using the image forming liquid-application amount-information acquired by the image forming liquid-application amount-information acquisition unit; a medium deformation amount-calculation unit that calculates the amount of deformation of the medium between a state where the tension is applied by the tension applying section and a state where the tension is not applied, using the tension information acquired by the tension-information acquisition unit and the elastic modulus of the medium acquired by the elastic modulus acquisition unit; an image conversion section that converts the image data, which is acquired by the image data acquisition section, into converted image data, which represents a converted image to be formed on the medium in a state where the tension is applied by the tension applying section, on the basis of the amount of deformation of the medium calculated by the medium deformation amount-calculation unit; and an image formation control section that controls image formation, which is performed by the image forming unit on the medium to which the tension is applied by the tension applying section and which is transported relative to the image forming unit by the transport unit, on the basis of the converted image data.

According to the first aspect, an image, which is made in consideration of the amount of deformation of the medium according to the amount of applied image forming liquid, is formed on the medium that is deformed due to the application of tension.

An image forming material is liquid that forms pixels of an image, and includes at least ink. Examples of ink include a cyan ink, a magenta ink, a yellow ink, and a black ink.

According to a second aspect, in the image forming apparatus of the first aspect, the elastic modulus acquisition unit may acquire the elastic modulus that is calculated using a Young's modulus corresponding to the amount of the applied image forming liquid acquired by the image forming liquid-application amount-information acquisition unit.

According to the second aspect, the elastic modulus of the medium, which is based on the Young's modulus corresponding to the amount of the applied image forming liquid, can be acquired.

According to a third aspect, the image forming apparatus of the second aspect may further comprise a Young's modulus storage section that stores a Young's modulus for each amount of the image forming liquid to be applied to the medium.

According to the third aspect, the Young's modulus of the medium for each amount of the image forming liquid can be acquired.

The Young's modulus storage section may store a Young's modulus for each type of a medium. The Young's modulus storage section may store a Young's modulus for each type of image forming liquid.

According to a fourth aspect, the image forming apparatus of the second or third aspect may further comprise a medium feed unit that feeds a fabric as the medium, and the elastic modulus acquisition unit may acquire the elastic modulus that is calculated using a Young's modulus of the fabric based on a type of yarn extending in a direction parallel to a direction of tension to be applied to the fabric.

According to the fourth aspect, a Young's modulus of a medium, which is made in consideration of a relationship between the posture of a fabric and the tension to be applied to the fabric, can be acquired.

According to a fifth aspect, in the image forming apparatus of any one of the first to fourth aspects, the elastic modulus acquisition unit may acquire an elastic modulus of each sub-region in a case in which the image data is divided into a plurality of sub-regions, the medium deformation amount-calculation unit may calculate the amount of deformation for each sub-region using the elastic modulus of each sub-region that is acquired by the elastic modulus acquisition unit, and the image conversion section may convert the image data, which is acquired by the image data acquisition section, for each sub-region using the amount of deformation of each sub-region that is calculated by the medium deformation amount-calculation unit.

According to the fifth aspect, even in a case in which the deformation of a medium is not linear, an image based on the amount of deformation of each sub-region can be formed.

The sub-region includes one or more pixels. The sub-region may be formed of a plurality of adjacent pixels.

According to a sixth aspect, in the image forming apparatus of the fifth aspect, the elastic modulus acquisition unit may acquire an elastic modulus of each sub-region on the basis of the amount of the image forming liquid to be applied to each sub-region.

According to the sixth aspect, an elastic modulus of each sub-region according to the amount of applied image forming liquid can be acquired. Further, since a plurality of sub-regions can be handled as one sub-region on the basis of the amount of image forming liquid applied to each sub-region, the number of sub-regions as objects to be subjected to an arithmetic operation is reduced. Accordingly, the number of times of arithmetic operations can be reduced.

According to a seventh aspect, in the image forming apparatus of the fifth aspect, the elastic modulus acquisition unit may acquire an elastic modulus of each sub-region on the basis of a Young's modulus of each sub-region.

According to the seventh aspect, the elastic modulus of each sub-region according to the Young's modulus of each sub-region can be acquired. Further, since a plurality of sub-regions can be handled as one sub-region on the basis of the Young's modulus of each sub-region, the number of sub-regions as objects to be subjected to an arithmetic operation is reduced. Accordingly, the number of times of arithmetic operations can be reduced.

According to an eighth aspect, in the image forming apparatus of the fifth aspect, the image conversion section may apply a deformation vector, which represents a magnitude of the amount of deformation of each sub-region and a direction of the deformation of each sub-region, to each of calculation nodes, which are set in the sub-regions of the image data acquired by the image data acquisition section, to generate deformed image data that represents a deformed image deformed from an image represented by the image data.

According to the eighth aspect, the amount of deformation at the calculation nodes of each sub-region can be calculated.

According to a ninth aspect, in the image forming apparatus of any one of the first to eighth aspects, the image conversion section may generate deformed image data representing a deformed image, which is deformed from an image represented by the image data acquired by the image data acquisition section so as to correspond to the amount of deformation of the medium, and may apply pixels of the image data to deformed pixels, which form the deformed image and are deformed from pixels serving as the minimum unit forming the image data, to generate converted image data that represents the converted image.

According to the ninth aspect, since stretched image data, which represents a stretched image in which the amount of deformation of a medium is reflected, is used, image data representing a converted image, which is to be formed on the medium to which tension is applied, is generated.

According to a tenth aspect, in the image Ruining apparatus of the ninth aspect, the image conversion section may use color information, which is an average of color information about the plurality of deformed pixels, as color information of each pixel of the converted image in a case in which color information about each pixel of the converted image includes color information about the plurality of deformed pixels of the deformed image.

According to the tenth aspect, color information about stretched pixels of the stretched image corresponding to each pixel of the converted image is reflected in each pixel of the converted image.

According to an eleventh aspect, in the image forming apparatus of the ninth aspect, the image conversion section may use color information about a pixel where an area ratio of each pixel of the converted image is high among the plurality of deformed pixels as color information about each pixel of the converted image in a case in which color information about each pixel of the converted image includes color information about the plurality of deformed pixels of the deformed image.

According to the eleventh aspect, color information about stretched pixels of the stretched image corresponding to each pixel of the converted image is reflected in each pixel of the converted image.

According to a twelfth aspect, in the image forming apparatus of any one of the first to eleventh aspects, the tension applying section may apply tension to the medium by a medium support roller that supports the medium transported by the transport unit and has a length equal to or longer than the entire length of the medium in a medium width direction which is a direction orthogonal to a relative transport direction of the medium in the transport unit, and the tension-information acquisition unit may acquire information about tension, which is applied to both ends of the medium in the medium width direction, by tension detection elements that are mounted on both ends of the medium support roller in the medium width direction.

According to the twelfth aspect, information about tension, which is made in consideration of the transport state of the medium and is applied to the medium, can be acquired.

According to a thirteenth aspect, in the image forming apparatus of any one of the first to twelfth aspects, the image forming unit may include an ink jet head that jets ink to the medium.

According to the thirteenth aspect, image formation using an ink jet system can be applied to the formation of an image to a medium to which tension is applied.

According to a fourteenth aspect, the image forming apparatus of the thirteenth aspect may further comprise a drying treatment section that is disposed at a position on a downstream side of the image forming unit in the relative transport direction of the medium and performs drying treatment on the medium to which ink is applied by the ink jet head.

According to the fourteenth aspect, the fixing of ink, which is applied to the medium, is facilitated.

According to a fifteenth aspect, the image forming apparatus of the thirteenth or fourteenth aspect may further comprise a treatment liquid application unit that applies treatment liquid for aggregating ink or treatment liquid for insolubilizing ink to the medium and is disposed at a position on an upstream side of the image foaming unit in the relative transport direction of the medium, and the image forming liquid-application amount-information acquisition unit may acquire information about the amount of treatment liquid, which is applied to the medium by the treatment liquid application unit, and information about the amount of ink, which is jetted from the ink jet head, as information about the amount of the applied image forming liquid.

According to the fifteenth aspect, the bleeding of ink applied to the medium is suppressed.

According to a sixteenth aspect, in the image forming apparatus of any one of the first to fifteenth aspects, the image formation control section may form dots on the medium at positions, which correspond to the pixels of the converted image data, by the image forming unit.

According to the sixteenth aspect, dots, which form an image represented by the converted image data, are formed on the medium at positions corresponding to the pixels of the converted image data.

An image forming method of a seventeenth aspect allows a medium to which tension is applied and an image forming unit, which forms an image on the medium, to be transported relative to each other and forms an image on the medium with image forming liquid including at least ink. The image forming method comprises: an image data acquisition step of acquiring image data; an image forming liquid-application amount-information acquisition step of acquiring image forming liquid-application amount-information that is information about the amount of the applied image forming liquid calculated on the basis of the image data acquired in the image data acquisition step; a tension information acquisition step of acquiring tension information that is information about the tension to be applied to the medium; an elastic modulus acquisition step of acquiring an elastic modulus of the medium to which the image forming liquid is applied, the elastic modulus of the medium being calculated using the image forming liquid-application amount-information acquired in the image forming liquid-application amount-information acquisition step; a medium deformation amount-calculation step of calculating the amount of deformation of the medium between a state where the tension is applied and a state where the tension is not applied, using the tension information acquired in the tension information acquisition step and the elastic modulus of the medium acquired in the elastic modulus acquisition step; an image conversion step of converting the image data, which is acquired in the image data acquisition step, into converted image data, which represents a converted image to be formed on the medium in a state where the tension is applied, on the basis of the amount of deformation of the medium calculated in the medium deformation amount-calculation step; and an image forming step of forming an image on the medium, to which the tension is applied and which is transported relative to the image forming unit, on the basis of the converted image data.

According to the seventeenth aspect, the same effects as the effects of the first aspect can be obtained.

The same items as the items specified in the second to sixteenth aspects can be appropriately combined in the seventeenth aspect. In this case, components taking on the processing or functions specified in the image forming apparatus can be grasped as components, which take on processing or functions corresponding to the above-mentioned processing or functions, of a method of detecting a short circuit.

According to the invention, an image, which is made in consideration of the amount of deformation of a medium according to the amount of applied image forming liquid, is formed on the medium that is deformed due to the application of tension.

DESCRIPTION OF THE PREFERRED EMBODIMENTS

Figure 1:
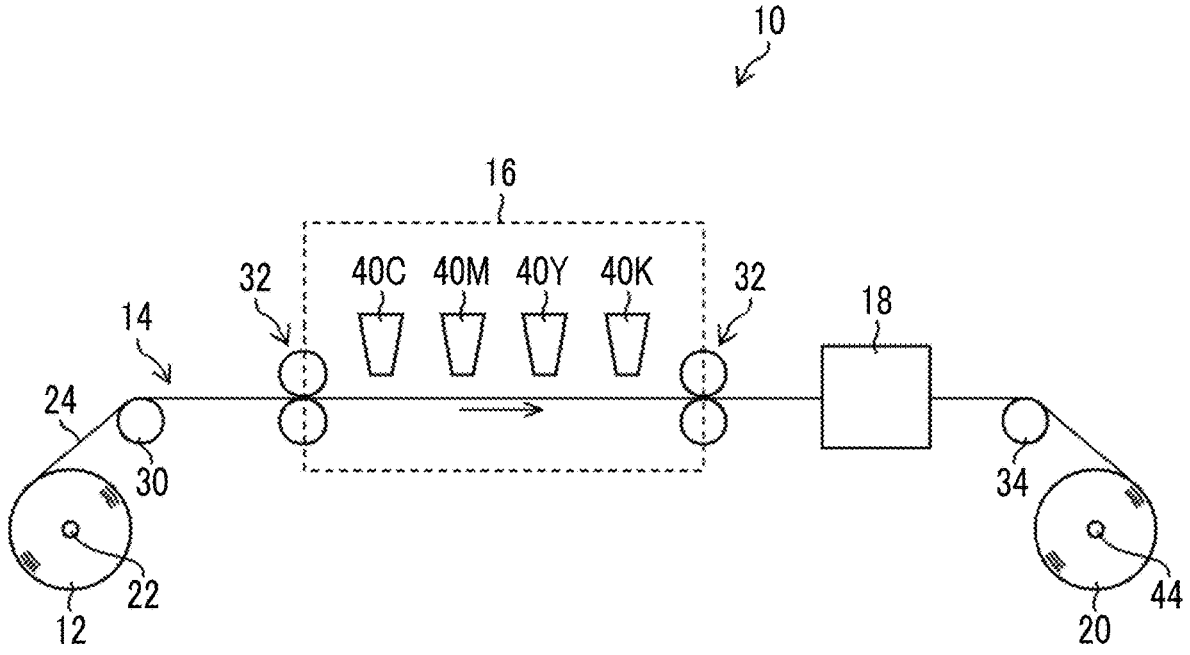
FIG. 1 is a diagram showing the overall configuration of an image forming apparatus according to a first embodiment.

Preferred embodiments of the invention will be described in detail below with reference to the drawings. In this specification, components having been already described will be denoted by the same Reference numerals and the description thereof will be appropriately omitted.

First Embodiment

<Overall Configuration of Image Forming Apparatus>

FIG. 1 is a diagram showing the overall configuration of an image forming apparatus according to a first embodiment. The ink jet recording apparatus 10 shown in FIG. 1 comprises a feed-side roll 12, a transport unit 14, an image forming unit 16, a post-treatment section 18, and a take-up roll 20.

In this embodiment, the ink jet recording apparatus in which an image is formed by an ink jet system is exemplified as an example of the image forming apparatus. Image formation described in this specification includes dyeing. An image described in this specification includes letters, numerals, or signs.

In the feed-side roll 12, a fabric 24 is wound on a core 22. The feed-side roll 12 is supported by a support member (not shown) so as to be rotatable about the core 22 serving as a rotating shaft. The feed-side roll 12 is one aspect of a medium feed unit.

The fabric 24 described in this specification includes a cloth or a textile in which two pieces of yarn are combined with each other. Further, the fabric 24 described in this specification may include a knit in which one piece of yarn is used, knots are formed, and a planar shape or a three-dimensional shape is formed.

The transport unit 14 comprises a transport roller 30, a plurality of pairs of nip rollers 32, and a tension roller 34. The transport unit 14 allows the fabric 24, which is led out of the feed-side roll 12, to pass through the image forming unit 16 and the post-treatment section 18 and transports the fabric 24 to the take-up roll 20.

The transport roller 30 has a cylindrical shape, and is rotatably supported by a support member (not shown). The entire length of the transport roller 30 in a longitudinal direction of the transport roller 30 corresponds to the entire length of the fabric 24 in a width direction of the fabric 24. The longitudinal direction of the transport roller 30 is a direction parallel to the axial direction of the transport roller 30. The tension roller 34 is one aspect of a medium support roller.

The width direction of the fabric 24 is a direction orthogonal to the transport direction of the fabric 24. Hereinafter, the transport direction of the fabric 24 may be referred to as a medium transport direction. Further, the width direction of the fabric 24 may be referred to as a medium width direction. An arrow of FIG. 1 indicates the medium transport direction of the image forming unit 16. The medium transport direction is one aspect of a relative transport direction.

Here, the term of "orthogonal" or "perpendicular" described in this specification includes "substantially orthogonal" or "substantially perpendicular" where the same effects as the effects, which are obtained in a case in which two directions cross each other at an angle of 90°, are obtained in a case in which two directions cross each other at an angle exceeding 90° or a case in which two directions cross each other at an angle less than 90°.

Further, the term of "parallel" described in this specification includes "substantially parallel" where two directions are not parallel to each other but the same effects as the effects, which are obtained in a case in which the two directions are parallel to each other, are obtained. Furthermore, the term of "the same" described in this specification includes "substantially the same" where components are different from each other but effects similar to the effects, which are obtained in a case in which the components are the same, can be obtained.

The transport roller 30 supports the back surface of the fabric 24 that is lead out of the feed-side roll 12. The back surface of the fabric 24 is a surface opposite to an image forming surface on which an image is formed. The transport roller 30 may have a structure in which a plurality of rollers are arranged in the longitudinal direction.

The plurality of pairs of nip rollers 32 are provided on the upstream side and the downstream side of the image forming unit 16 in the medium transport direction. FIG. 1 shows an aspect in which a pair of nip rollers 32 is provided on each of the upstream side and the downstream side of the image forming unit 16 in the medium transport direction.

The tension roller 34 applies tension, which acts toward the downstream side from the upstream side in the medium transport direction, to the fabric 24 that is transported by the transport unit 14. Further, the tension roller 34 supports the back surface of the fabric 24. Furthermore, a tension detection sensor is mounted on the tension roller 34.

The tension detection sensor is not shown in FIG. 1. The tension detection sensor is denoted in FIG. 9 by Reference numeral 70A. The detail of the tension detection sensor will be described later.

The transport unit 14 is one aspect of a transport unit that allows a medium and the image forming unit to be transported relative to each other. Examples of as an aspect in which a medium and the image forming unit are allowed to be transported relative to each other include an aspect in which the image forming unit is allowed to move relative to a fixed medium and an aspect in which both a medium and the image forming unit are allowed to be transported.

The image forming unit 16 comprises an ink jet head 40C, an ink jet head 40M, an ink jet head 40Y, and an ink jet head 40K. The image forming unit 16 forms an image on the fabric 24, which is transported by the transport unit 14, with at least one color ink of a cyan ink, a magenta ink, a yellow ink, and a black ink.

The ink jet heads 40C, 40M, 40Y, and 40K are arranged in the medium transport direction in the order of the ink jet heads 40C, 40M, 40Y, and 40K from the upstream side in the medium transport direction.

The ink jet head 40C is provided with jetting elements that jet a cyan ink to the fabric 24. The ink jet head 40M is provided with jetting elements that jet a magenta ink to the fabric 24.

The ink jet head 40Y is provided with jetting elements that jet a yellow ink to the fabric 24. The ink jet head 40K is provided with jetting elements that jet a black ink to the fabric 24.

Each of the ink jet heads 40C, 40M, 40Y, and 40K is a line-type head in which a plurality of jetting elements are arranged over a length corresponding to the entire length of the fabric 24 in the medium width direction. A similar structure can be applied to the ink jet heads 40C, 40M, 40Y, and 40K.

In a case in which the ink jet heads 40C, 40M, 40Y, and 40K do not need to be distinguished from each other, the ink jet heads may be described as the ink jet heads 40 below. The ink is one aspect of image forming liquid.

The post-treatment section 18 comprises an ink drying device (not shown). The post-treatment section 18 performs treatment for drying an ink on the fabric 24 on which an image is formed by the image forming unit 16.

The post-treatment section 18 comprises a steam applying device (not shown). The post-treatment section 18 uses the steam applying device to apply steam to the fabric 24 on which the image is formed by the image forming unit 16. Since steam is applied to the fabric 24 on which the image is formed, color materials contained in the inks are fixed to the fabric 24.

Heated air, steam saturated under normal pressure, or superheated steam can be applied as the steam. It is preferable that steam saturated under normal pressure is used. It is preferable that the temperature range of the steam is the range of 90° C. to 140° C. It is more preferable that the temperature range of the steam is the range of 100° C. to 108° C.

It is preferable that a period in which the steam is applied is in the range of 1 minute to 60 minutes. It is more preferable that a period in which the steam is applied is in the range of 1 minute to 30 minutes.

The post-treatment section 18 comprises a washing device (not shown). The post-treatment section 18 uses the washing device to perform water-washing treatment on the fabric 24 on which the image is formed by the image forming unit 16 and to which the steam is applied.

Water may contain a soaping agent. Since unfixed color materials are removed, excellent results are obtained in terms of various types of water resistance, such as washing fastness and perspiration fastness.

Since the water-washing treatment is performed on the fabric 24 to which the steam has been applied, color materials not fixed to the fabric 24 are removed. The range of a normal temperature to 100° C. can be applied as the temperature range of water. Any temperature in the range of 5° C. to 35° C. may be applied as the normal temperature that is mentioned here. For example, a temperature of 20° C. can be applied as the normal temperature.

The post-treatment section 18 comprises a drying device (not shown). The post-treatment section 18 uses a drying device to perform drying treatment on the fabric 24 where the image is formed by the image forming unit 16, the steam is applied, and the water-washing treatment is performed.

Examples of the drying treatment include dehydration treatment, heating treatment, and blast treatment.

The post-treatment section 18 is one aspect of a drying treatment section. The position of the post-treatment section 18 corresponds to a position on the downstream side of the image forming unit in the relative transport direction of a medium. Since the drying treatment is performed, the fixing of the image to the fabric is facilitated.

An aspect in which post-treatment is performed on the fabric 24 on which the image is formed by the image forming unit 16 in a state where tension is applied to the fabric 24 is described in this embodiment. Post-treatment, which is to be performed by the post-treatment section 18, may be performed in a state where tension is not applied to the fabric 24. In such an aspect, the post-treatment section 18 shown in FIG. 1 is not disposed at the position shown in FIG. 1. The same applies to a second embodiment to be described later.

Treatment liquid is a high-molecular compound, and it is thought that there are very few treatment liquids that have relatively high adhesion to the fabric 24 and are removed by water-washing treatment. Further, an ink, which is not fixed to the fabric 24, is removed from the fabric 24 by the water-washing treatment. However, it is thought that a ratio of the ink, which is not fixed to the fabric 24, to the ink, which is fixed to the fabric 24, is very low.

It is thought that a difference between the elastic modulus of the fabric 24 derived in consideration of the amount of the ink, which is removed from the fabric 24 by the water-washing treatment, and the elastic modulus of the fabric 24 derived without the consideration of the amount of the ink, which is removed from the fabric 24 by the water-washing treatment, is negligible.

That is, it is thought that the elastic modulus of the fabric 24 does not need to be corrected in regard to the amount of the ink removed from the fabric 24 by the water-washing treatment.

The take-up roll 20 is supported so as to be rotatable about a core 44 serving as a rotating shaft. The fabric 24 can be wound on the take-up roll 20. The fabric 24 on which the image is formed and drying treatment is performed is wound on the core 44, so that the take-up roll 20 receives the fabric 24.

After the fabric 24 passes by the tension roller 34, tension applied by the tension roller 34 is removed. The fabric 24 is received by the take-up roll 20 in a state where the tension applied by the tension roller 34 is removed.

Components of the ink jet recording apparatus 10 shown in FIG. 1 can be appropriately modified, added, or deleted.

<Schematic Configuration of Control System>

Figure 2:
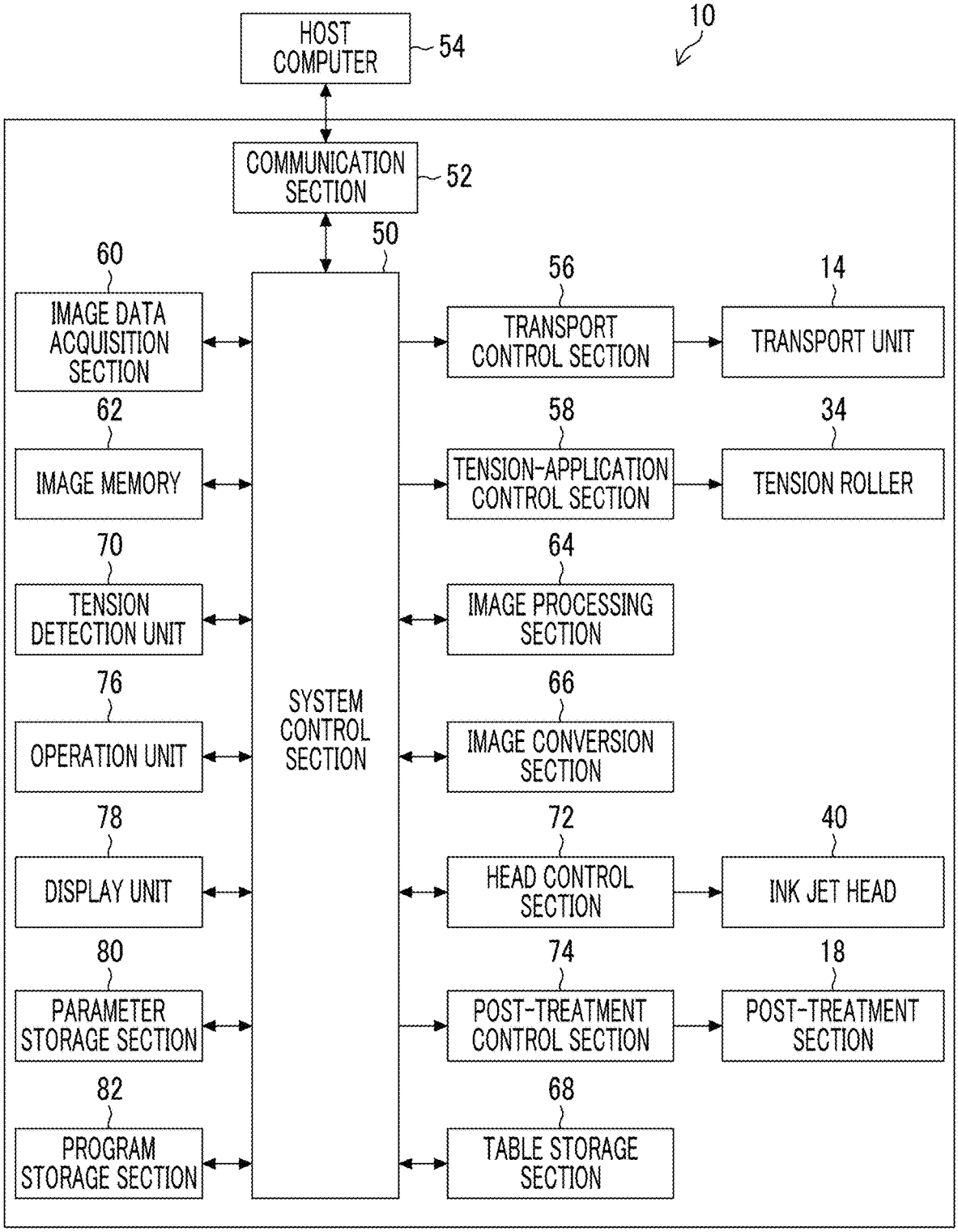
FIG. 2 is a block diagram showing the schematic configuration of a control system of the image forming apparatus shown in FIG. 1.

FIG. 2 is a block diagram showing the schematic configuration of a control system of the image forming apparatus shown in FIG. 1. The ink jet recording apparatus 10 shown in FIG. 2 comprises a system control section 50.

Configuration, which includes a CPU, a ROM, and a RAM, can be applied to the system control section 50. CPU is an abbreviation for Central Processing Unit. ROM is an abbreviation for Read Only Memory. RAM is an abbreviation for Random Access Memory. The CPU, the ROM, and the RAM are not shown.

The system control section 50 functions as an overall control section that generally controls the respective components of the ink jet recording apparatus 10. Further, the system control section 50 functions as an arithmetic section that performs various types of arithmetic processing.

Furthermore, the system control section 50 functions as a memory controller that controls the writing of data in a memory device of the ink jet recording apparatus 10 and the reading of data from the memory device.

The ink jet recording apparatus 10 shown in FIG. 2 comprises a communication section 52. The communication section 52 comprises a communication interface (not shown). The communication section 52 can transmit and receive data to and from a host computer 54 connected to the communication interface.

The ink jet recording apparatus 10 shown in FIG. 2 comprises a transport control section 56. The transport control section 56 controls the operation of the transport unit 14 on the basis of a command signal that is sent from the system control section 50. The transport control section 56 controls the start of transport of the fabric 24 shown in FIG. 1, the stop of transport of the fabric 24, and the transport speed of the fabric 24.

The transport control section 56 shown in FIG. 2 controls nip pressure of the pairs of nip rollers 32 on the basis of the transport conditions of the fabric 24 and the image forming conditions of the image forming unit 16 shown in FIG. 1.

The tension-application control section 58 controls the application of tension to the fabric 24, which is performed by the tension roller 34, on the basis of a command signal that is sent from the system control section 50. The tension roller 34 and the tension-application control section 58 are one aspect of a tension applying section.

The ink jet recording apparatus 10 shown in FIG. 2 comprises an image data acquisition section 60, an image memory 62, and an image processing section 64. The image data acquisition section 60 acquires image data that is taken from the host computer 54 through the communication section 52. Examples of the image data include raster data having a serial format.

The image memory 62 functions as a temporary storage unit for various data including image data. Data is read and written from and in the image memory 62 through the system control section 50. The image data, which is taken from the host computer 54 through the communication section 52 and is acquired through the image data acquisition section 60, is temporarily stored in the image memory 62.

The image processing section 64 generates dot data by performing color separation processing, color conversion processing, correction processing, and halftoning on the image data that is acquired through the image data acquisition section 60.

That is, the image processing section 64 comprises a color separation processing unit, a color conversion processing unit, a correction processing unit, and a halftoning unit. The color separation processing unit, the color conversion processing unit, the correction processing unit, and the halftoning unit are not shown.

In the color separation processing unit, color separation processing is performed on input image data. For example, in a case in which input image data is represented by RGB, the input image data is separated into data of the respective colors of R, G, and B. Here, R represents red. G represents green. B represents blue.

In the color conversion processing unit, image data, which are separated into R, G, and B and correspond to the respective colors, are converted into C, M, Y, and K corresponding to the colors of inks. Here, C represents cyan. M represents magenta. Y represents yellow. K represents black. K representing black is an upper-case letter.

In the correction processing unit, correction processing is performed on image data that are converted into C, M, Y, and K and correspond to the respective colors. Examples of the correction processing include gamma correction processing, density unevenness-correction processing, abnormality recording element-correction processing, and the like.

In the halftoning unit, image data represented by the number of multiple gradations in the range of, for example, 0 to 255 is converted into dot data represented by a binary value or a multi-level value that is a ternary value or more and is smaller than the number of gradations of the input image data.

In the halftoning unit, a predetermined halftoning rule is applied. Examples of the halftoning rule include a dither method, an error diffusion method, and the like. The halftoning rule may be changed according to image recording conditions, the contents of image data, or the like.

The ink jet recording apparatus 10 shown in FIG. 2 comprises an image conversion section 66. The image conversion section 66 generates stretched image data, which represents a stretched image corresponding to the fabric 24 stretched by applied tension, in regard to the image data that is acquired by the image data acquisition section 60. Then, the image conversion section 66 generates converted image data that represents a converted image of which pixels are assigned to the stretched image.

The detail of conversion processing, which is performed by the image conversion section 66, will be described later. The stretched image is one aspect of a deformed image. The stretched image data is one aspect of deformed image data.

An image forming liquid-application amount-information acquisition unit for acquiring image forming liquid-application amount-information, which is information about the amount of image forming liquid to be applied, is a component of the image conversion section 66. An elastic modulus acquisition unit, which acquires the elastic modulus of a medium, is a component of the image conversion section 66. A medium deformation amount-calculation unit, which calculates the amount of deformation of a medium between a state where tension is applied and a state where tension is not applied, is a component of the image conversion section 66.

A table storage section 68 stores a data table that is applied to various types of processing. Examples of the data table include a data table in which a relationship between the amount of ink to be applied to the image conversion processing of the image conversion section 66 and the Young's modulus of the fabric 24 is prescribed. The table storage section 68 is one aspect of a Young's modulus storage section.

The ink jet recording apparatus 10 shown in FIG. 2 comprises a tension detection unit 70. The tension detection unit 70 detects tension that is applied to the fabric 24 by the tension roller 34.

The detection result of the tension detection unit 70 is sent to the image conversion section 66 through the system control section 50. The image conversion section 66 performs conversion processing using the information about the tension applied to the fabric 24 that is sent from the tension detection unit 70 through the system control section 50. The tension detection unit 70 is one aspect of a tension-information acquisition unit. The tension detection unit 70 is one aspect of a tension detection element.

The ink jet recording apparatus 10 shown in FIG. 2 comprises a head control section 72 and a post-treatment control section 74. The head control section 72 controls the operation of the ink jet head 40 on the basis of the image data that is processed by the image processing section 64. The head control section 72 is one aspect of an image formation control section. The head control section 72 forms dots on the fabric 24 at positions, which correspond to the pixels of the converted image data, by the ink jet head 40.

The post-treatment control section 74 controls the operation of the post-treatment section 18 on the basis of a command that is sent from the system control section 50. The post-treatment control section 74 controls the operation start timing of the post-treatment section 18, the operation stop timing of the post-treatment section 18, and the treatment temperature of the post-treatment section 18.

The ink jet recording apparatus 10 shown in FIG. 2 comprises an operation unit 76 and a display unit 78. An input device, such as a mouse or a keyboard, can be applied as the operation unit 76. A display device, such as an LCD monitor, can be applied as the display unit 78.

The ink jet recording apparatus 10 shown in FIG. 2 comprises a parameter storage section 80 and a program storage section 82.

The parameter storage section 80 stores various parameters that are used in the ink jet recording apparatus 10. The various parameters, which are stored in the parameter storage section 80, are read through the system control section 50 and are set in the respective components of the apparatus.

The program storage section 82 stores programs that are used in the respective components of the ink jet recording apparatus 10. Various programs, which are stored in the program storage section 82, are read through the system control section 50 and are executed in the respective components of the apparatus.

The respective components are enumerated in FIG. 2 for the respective functions. The respective components shown in FIG. 2 can be appropriately integrated with each other, separated from each other, used for other purposes, or omitted. Further, each of the components shown in FIG. 2 can be formed of an appropriate combination of hardware including at least one processor and software for operating the processor.

A memory to which at least one processor and the software for operating the processor refer may be provided. An electrical circuit may be applied as each of the components shown in FIG. 2 instead of a combination of hardware including at least one processor and software for operating the processor.

<Action of Image Forming Apparatus>

The action of the ink jet recording apparatus 10 shown in FIGS. 1 and 2 are as follows. Tension is applied to the fabric 24, which is lead out of the feed-side roll 12 shown in FIG. 1, toward the downstream side from the upstream side in the medium transport direction by the tension roller 34.

That is, the fabric 24 is transported in a state where the fabric 24 is stretched in a direction parallel to the medium transport direction. The fabric 24 to which tension is applied by the tension roller 34 is transported to the image forming unit 16 through the transport roller 30 and the pair of nip rollers 32.

In the image forming unit 16, an image is formed on the fabric 24 on the basis of image data. The fabric 24 on which the image is formed by the image forming unit 16 is transported to the post-treatment section 18. In the post-treatment section 18, post-treatment, such as drying treatment, is performed on the fabric 24 on which the image is formed by the image forming unit 16.

The fabric 24 on which the post-treatment is performed by the post-treatment section 18 is received to the take-up roll 20 through the tension roller 34.

[Detailed Description of Image Conversion Processing]

<Overview of Image Conversion Processing>

Figure 3:
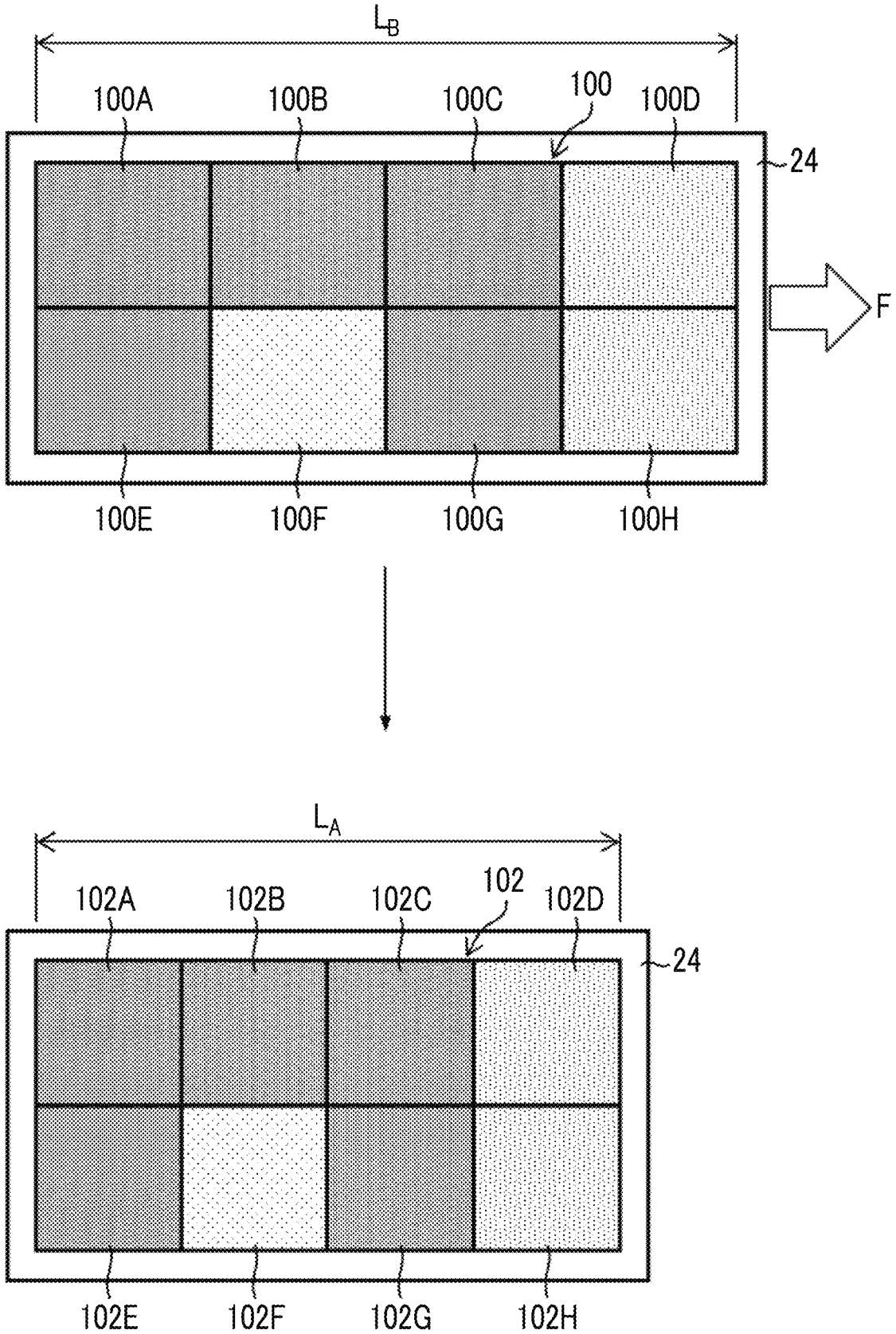
FIG. 3 is a schematic diagram showing image conversion processing that is applied to the image forming apparatus shown in FIG. 1.

FIG. 3 is a schematic diagram showing the image conversion processing that is applied to the image forming apparatus shown in FIG. 1. An image 100 shown in FIG. 3 is an image that is formed on the fabric 24 to which tension F is applied, and is an image that is actually formed on the fabric 24. The tension F corresponds to tension to be applied to a medium.

An image 102 shown in FIG. 3 is an image of a fabric 24 that is in an unloaded state where the tension F is removed, is an image to be expected, and is a desired image. The image 102 is an image that has contracted from the image 100 formed on the fabric 24 due to the contraction of the fabric 24.

Reference numeral $L_A$ denotes the entire length of the image formed on the fabric 24, which is in the unloaded state where the tension F is removed, in a sheet transport direction. Reference numeral $L_B$ denotes the entire length of the image formed on the fabric 24, to which the tension F is applied, in the sheet transport direction. The sheet transport direction in FIG. 3 is a direction parallel to the direction of the tension F. The same applies to FIGS. 4 to 6 and FIGS. 9 to 11.

That is, the image conversion processing of the image formation described in this embodiment includes processing for calculating the stretched length of the fabric 24, which is a medium, and stretching image data in the stretching direction of the fabric 24 so as to correspond to the stretched length of the fabric 24.

In a case in which the tension F is applied to the fabric 24, the fabric 24 may contract in a direction orthogonal to the direction of the tension F. However, it is thought that the contraction length of the fabric 24 in the direction orthogonal to the direction of the tension F is sufficiently shorter than the stretched length of the fabric 24 in the direction parallel to the direction of the tension F. Accordingly, it is regarded that the fabric 24 does not contract in the direction orthogonal to the direction of the tension F in a case in which the tension F is applied to the fabric 24.

In the image 100 shown in FIG. 3, a difference in the amount of ink per unit region is shown by a difference in dot hatching. A first region 100A, a second region 100B, a third region 100C, a fifth region 100E, and a seventh region 100G of the image 100 are regions to which the same amount of ink is applied. A fourth region 100D and an eighth region 100H are regions to which the same amount of ink is applied. A sixth region 100F is a region of which the amount of ink to be applied is different from the amount of ink to be applied to the other regions.

For example, the amount of ink, which exceeds the amount of ink of the fourth region 100D, is applied to the first region 100A. The amount of ink, which exceeds the amount of ink of the sixth region 100F, is applied to the fourth region 100D. A relationship between the amount of ink to be applied to each region and the amount of ink to be applied to the other region in the image 102 is also the same as that in the image 100.

That is, a first region 102A, a second region 102B, a third region 102C, a fifth region 102E, and a seventh region 102G of the image 102 are regions to which the same amount of ink is applied. A fourth region 102D and an eighth region 102H are regions to which the same amount of ink is applied. A sixth region 102F is a region of which the amount of ink to be applied is different from the amount of ink to be applied to the other regions.

For example, the amount of ink, which exceeds the amount of ink of the fourth region 102D, is applied to the first region 102A. The amount of ink, which exceeds the amount of ink of the sixth region 102F, is applied to the fourth region 102D.

Figure 4:
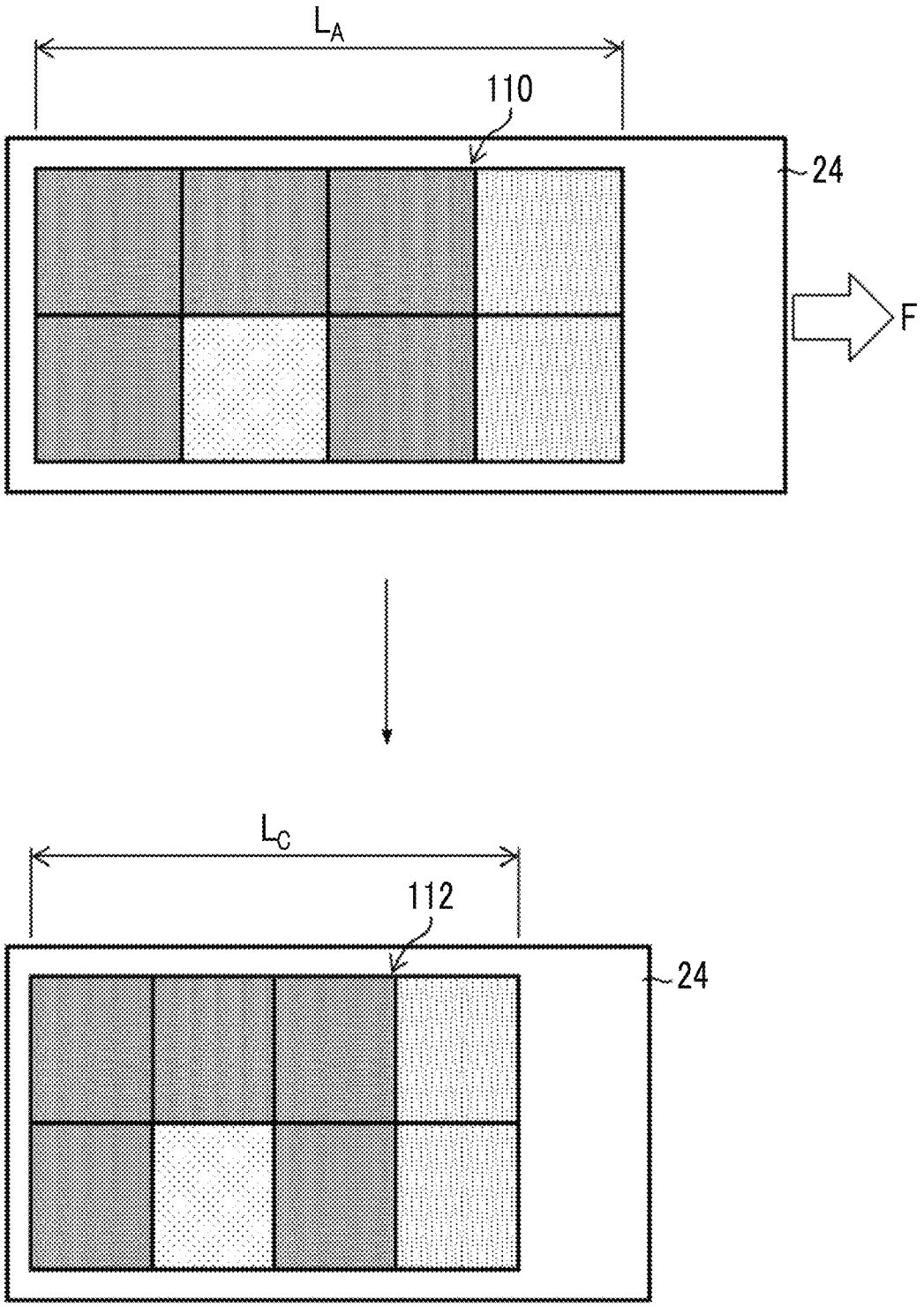
FIG. 4 is a diagram schematically showing an image that is formed by an image forming apparatus in the related art.

FIG. 4 is a diagram schematically showing an image that is formed by an image forming apparatus in the related art. An image 110 shown in FIG. 4 is an image that is formed on a fabric 24 to which tension F is applied, and is an image that is formed on the fabric 24 using image data not subjected to the image conversion processing corresponding to the stretched length of the fabric 24. An image 112 shown in FIG. 4 is an image of the fabric 24 on which the image 110 is formed and which is in an unloaded state where the tension F is removed, and is an image in which contraction corresponding to the contraction length of the fabric 24 occurs.

The images 110 and 112 shown in FIG. 4 are similar to the images 100 and 102 shown in FIG. 3 in that the amounts of ink of the respective regions are shown by a plurality of types of dot hatching. Reference numerals of the respective regions of the images 110 and 112 are not shown in FIG. 4.

The entire length $L_C$ of the image 112 shown in FIG. 4 in a sheet transport direction is less than the entire length $L_A$ of the image 102, which is shown in FIG. 3 and is formed on the fabric 24 in the unloaded state where the tension F is removed, in the sheet transport direction.

The image conversion processing to be described in detail below is processing to be performed on image data in a case in which the image 102 shown in FIG. 3 and formed on the fabric 24 in the unloaded state where the tension F is removed is to be obtained.

<Description of Elastic Deformation of Fabric>

Figure 5:
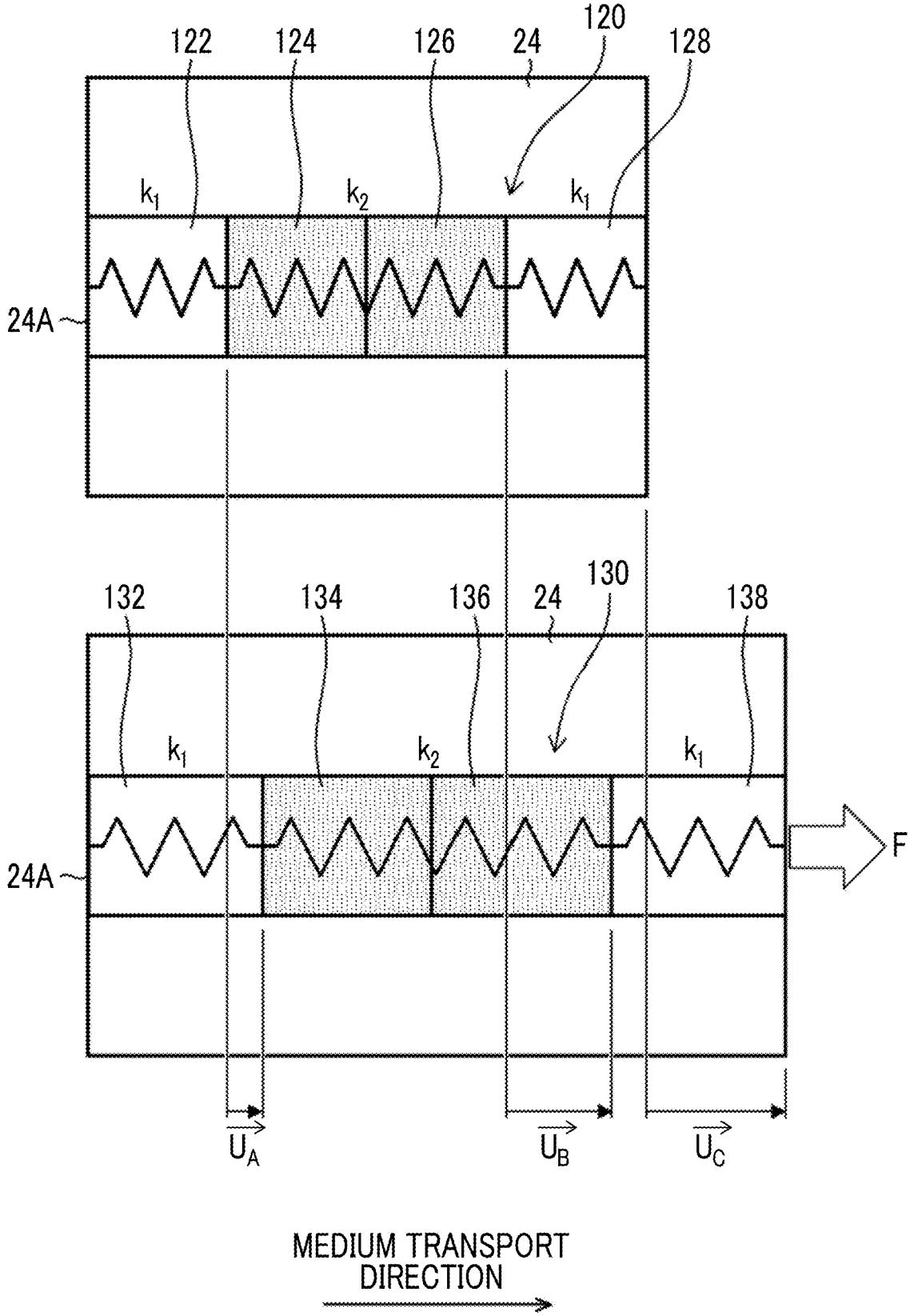
FIG. 5 is a diagram showing the elastic deformation of a fabric.

FIG. 5 is a diagram showing the elastic deformation of the fabric. An unconverted image 120 shown in FIG. 5 is an image of the fabric 24 that is in the unloaded state where the tension F is removed. The unconverted image 120 shown in FIG. 5 is an image to be expected, and is a desired image. The image to be expected is an image where deformation caused by the elastic deformation of the fabric 24 does not substantially occur.

The length of one side of each pixel in a monitor coordinate system, which is a coordinate system set on image data, is 10 micrometers in a medium coordinate system that is set on the fabric 24 on which the image has been formed. Micro means $10^{-6}$.

The unconverted image 120 includes four pixels, that is, a first pixel 122, a second pixel 124, a third pixel 126, and a fourth pixel 128. The unconverted image 120 shown in FIG. 5 corresponds to the image 102 shown in FIG. 3.

In a case in which color information about cyan is denoted by $C_L$, color information about magenta is denoted by $M_L$, color information about yellow is denoted by $Y_L$, and color information about black is denoted by $K_L$ in regard to the first and fourth pixels 122 and 128, a first amount $V_L$ of ink to be applied to each of the first and fourth pixels 122 and 128 is represented by "$V_L=C_L+M_L+Y_L+K_L$". K, which denotes color information about black, is an upper-case letter.

The first amount $V_L$ of ink of the first pixel 122 is represented by a ratio thereof in a case in which the maximum amount of four color inks to be applied to the first pixel 122 is assumed as 1. Further, the first amount $V_L$ of ink of the fourth pixel 128 is represented by a ratio thereof in a case in which the maximum amount of four color inks to be applied to the fourth pixel 128 is assumed as 1.

Here, $C_L$, which denotes color information about cyan of the first pixel 122, is a ratio of the amount of cyan ink to be applied to the first pixel 122 in a case in which the maximum value of the amount of cyan ink capable of being applied to the first pixel 122 is assumed as 1. The amount of cyan ink to be applied to the first pixel 122 is divided by the maximum value of the amount of cyan ink capable of being applied to the first pixel 122 and the result value of the division is multiplied by 100, so that the ratio of the amount of cyan ink to be applied to the first pixel 122 is calculated. The unit of $C_L$, $M_L$, $Y_L$, and $K_L$ is percentage.

The same applies to $M_L$ that denotes color information about magenta of the first pixel 122, $Y_L$ that denotes color information about yellow of the first pixel 122, and $K_L$ that denotes color information about black of the first pixel 122. Further, the same applies to the fourth pixel 128.

In a case in which color information about cyan is denoted by $C_H$, color information about magenta is denoted by $M_H$, color information about yellow is denoted by $Y_H$, and color information about black is denoted by $K_H$ in regard to the second and third pixels 124 and 126, a second amount $V_H$ of ink to be applied to each of the second pixel 124 and the third pixel is represented by "$V_H=C_H+M_H+Y_H+K_H$".

Color information $C_H$ about cyan, color information $M_H$ about magenta, color information $Y_H$ about yellow, and color information $K_H$ about black in the second and third pixels 124 and 126 are similar to $C_L$ that denotes color information about cyan of the first pixel 122 having been described above. The description thereof will be omitted.

The second amount $V_H$ of ink of the second pixel 124 is represented by a ratio thereof in a case in which the maximum amount of four color inks to be applied to the second pixel 124 is assumed as 1. Further, the second amount $V_H$ of ink of the third pixel 126 is represented by a ratio thereof in a case in which the maximum amount of four color inks to be applied to the third pixel 126 is assumed as 1. The first amount $V_L$ of ink and the second amount $V_H$ of ink have a relationship of "$V_L<V_H$".

That is, the first and fourth pixels 122 and 128 are pixels of the densities are lower than the densities of the second and third pixels 124 and 126.

Reference numeral $k_1$ shown in FIG. 5 denotes the elastic modulus of each of the first and fourth pixels 122 and 128. Further, Reference numeral $k_2$ denotes the elastic modulus of each of the second and third pixels 124 and 126. k, which denotes an elastic modulus, is a lower-case letter.

A stretched image 130 shown in FIG. 5 is an image that is actually formed on the fabric 24 to which tension F is applied. The stretched image 130 is an image stretched from the unconverted image 120 in the medium transport direction that is a direction in which the tension F is applied. A stretched pixel is one aspect of a deformed pixel that is deformed from a pixel serving as the minimum unit of image data.

The stretched image 130 includes four stretched pixels, that is, a first stretched pixel 132, a second stretched pixel 134, a third stretched pixel 136, and a fourth stretched pixel 138. The stretched pixel is a pixel stretched from a pixel of the unconverted image 120 in the medium transport direction that is the direction in which the tension F is applied.

The first stretched pixel 132, the second stretched pixel 134, the third stretched pixel 136, and the fourth stretched pixel 138 are pixels stretched from the first pixel 122, the second pixel 124, the third pixel 126, and the fourth pixel 128, respectively, in the medium transport direction that is the direction in which the tension F is applied.

An elastic modulus according to the amount of ink to be applied to each pixel is derived in the image conversion processing that is applied to the image formation of the ink jet recording apparatus 10 described in this embodiment. Then, the derived elastic moduli are used and processing for converting the unconverted image 120 into the stretched image 130 is performed.

Deformation vectors {U} are used in the conversion of the unconverted image 120 into the stretched image 130. The deformation vector {U} is a generic name of a deformation vector $\{U_A\}$, a deformation vector $\{U_B\}$, and a deformation vector $\{U_C\}$ shown in FIG. 5. In this specification, curly brackets are used to represent a vector.

The magnitude $|U_A|$ of the deformation vector $\{U_A\}$ is represented by "$|U_A|=k_1/|F|$" using the elastic modulus $k_1$ of the first pixel 122 and the magnitude |F| of the tension F to be applied to the fabric 24. The magnitude $|U_A|$ of the deformation vector $\{U_A\}$ is the stretched length of the first pixel 122.

The magnitude $|U_B|$ of the deformation vector $\{U_B\}$ is represented by "$|U_B|=k_2/|F|$" using the elastic modulus $k_2$ of the second pixel 124 and the magnitude |F| of the tension F to be applied to the fabric 24.

The magnitude $|U_B|$ of the deformation vector $\{U_B\}$ is the sum of the stretched length of the second pixel 124 and the stretched length of the third pixel 126. Since the second and third pixels 124 and 126 shown in FIG. 5 have the same elastic modulus $k_2$, the second and third pixels 124 and 126 are handled as one pixel.

The magnitude $|U_C|$ of the deformation vector $\{U_C\}$ is represented by "$|U_C|=k_1/|F|$" using the elastic modulus $k_1$ of the fourth pixel 128 and the magnitude |F| of the tension F to be applied to the fabric 24.

The magnitude $|U_C|$ of the deformation vector $\{U_C\}$ is the sum of the stretched length of the first pixel 122, the stretched length of the second pixel 124, and the stretched lengths of the third and fourth pixels 126 and 128.

In this embodiment, the positive direction of the deformation vector is a direction in which the fabric 24 is to be stretched. The direction in which the fabric 24 is to be stretched is the same direction as the direction of the tension F that is to be applied to the fabric 24. Further, the negative direction of the deformation vector is a direction in which the fabric 24 is to contract. The direction in which the fabric 24 is to contract is a direction opposite to the direction of the tension F that is to be applied to the fabric 24.

The direction of the tension F is the same direction as the medium transport direction. The positive direction of the deformation vector is the same direction as the medium transport direction. Further, the negative direction of the deformation vector is a direction opposite to the medium transport direction.

<Setting of Calculation Node>

Figure 6:
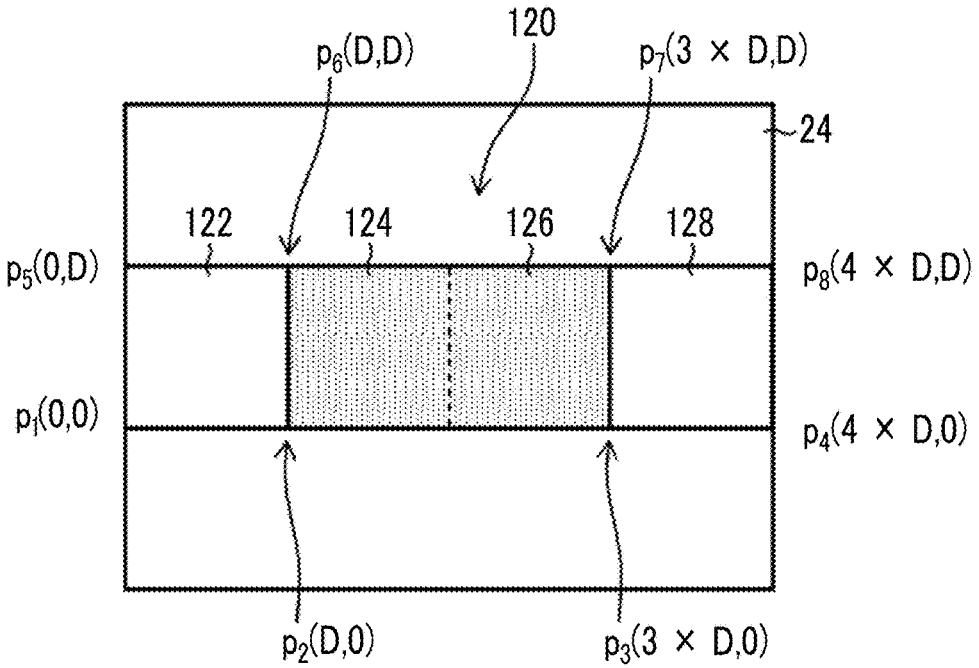
FIG. 6 is a diagram illustrating calculation nodes.

FIG. 6 is a diagram illustrating calculation nodes. After the elastic modulus k of each pixel is derived, calculation nodes are set in the unconverted image 120. Coordinate values in a medium coordinate system, which is a coordinate system set on the fabric 24, are used to indicate first to eighth calculation nodes $p_1$ to $p_8$ shown in FIG. 6.

The first calculation node $p_1$ (0,0), the second calculation node $p_2$ (D,0), the fifth calculation node $p_5$ (0,D), and the sixth calculation node $p_6$ (D,D) are set at four corners of the first pixel 122 of the unconverted image 120 shown in FIG. 6.

Here, D denotes the length of one side of each pixel of the unconverted image 120. Further, D denotes the length of a short side of each pixel of the stretched image 130. The short side of each pixel of the stretched image 130 is the side of each pixel in a direction parallel to the direction orthogonal to a direction in which each pixel is to be stretched or to contract.

Further, the third calculation node $p_3$ (3×D,0) and the seventh calculation node $p_7$ (3×D,D) are set at two corners of the third pixel 126. Furthermore, the fourth calculation node $p_4$ (4×D,0) and the eighth calculation node $p_8$ (4×D,D) are set at two corners of the fourth pixel 128.

Here, since the amount of ink to be applied to the second pixel 124 is the same as the amount of ink to be applied to the third pixel 126, the elastic modulus of the second pixel 124 is the same as that of the third pixel 126. The second and third pixels 124 and 126 are adjacent to each other. Accordingly, the second and third pixels 124 and 126 can be handled as one pixel.

Since a plurality of pixels are handled as one pixel in this way, the number of objects to be subjected to an arithmetic operation is reduced. Accordingly, the number of times of arithmetic operations can be reduced. Examples of a condition that allows the plurality of pixels to be handled as one pixel in an arithmetic operation include a condition where a plurality of pixels have the same elastic modulus and are disposed adjacent to each other.

A condition where the elastic moduli are the same elastic modulus may be a condition where the elastic moduli are in a predetermined range. For example, in a case in which the entire range of the amount of ink is divided into two or more ranges, pixels of the range of the amount of ink of each divided range may be handled as one pixel. The term of "pixel" includes pixels in a case in which a plurality of pixels are handled as one pixel in calculation.

An aspect in which four calculation nodes are set for each pixel is exemplified in FIG. 6, but the number of calculation nodes of each pixel has only to be one or more. For example, calculation nodes may be set at any one or more of the four corners of each pixel.

Further, calculation nodes of each pixel are not limited to the corners of each pixel. Coordinate values in a medium coordinate system that are coordinate values on the fabric 24, and coordinate values in a monitor coordinate system that are coordinate values on image data have only to be capable of being set. For example, a calculation node may be set at the representative position of each pixel, such as the central position of each pixel.

<Derivation of Elastic Modulus>

Figure 7:
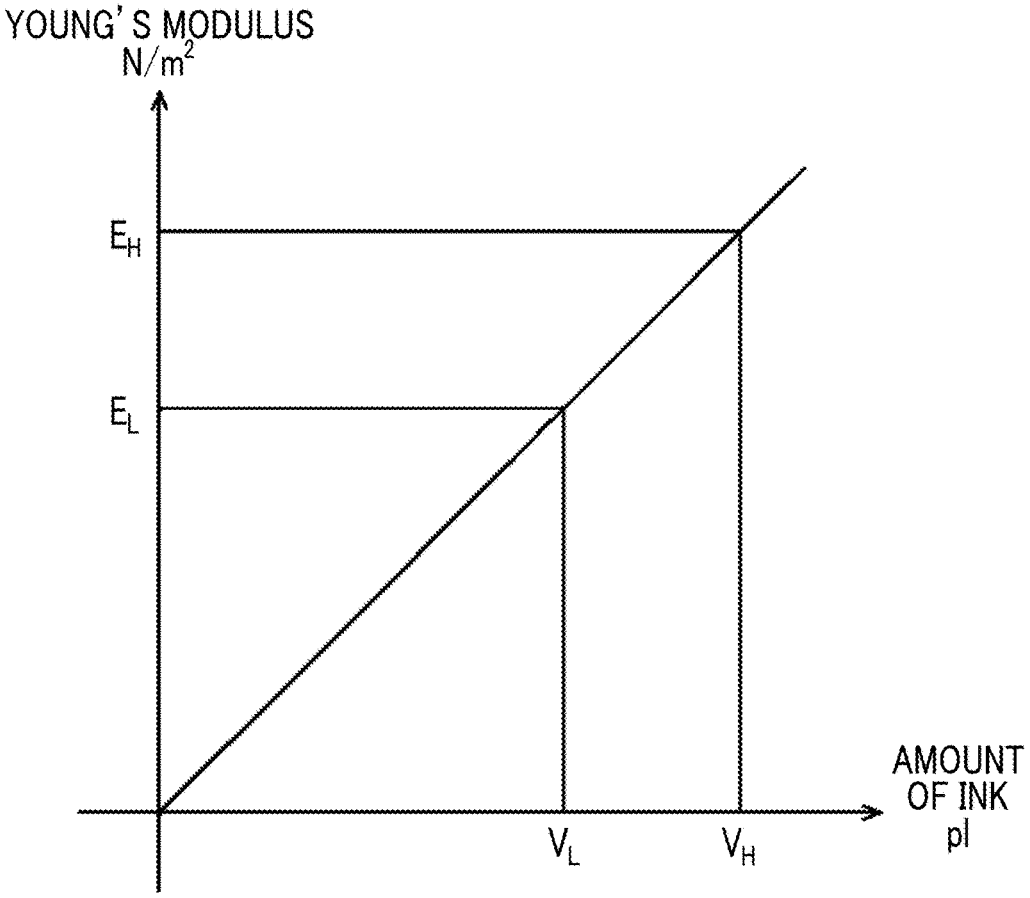
FIG. 7 is a graph illustrating a Young's modulus table.

FIG. 7 is a graph illustrating a Young's modulus table. The graph shown in FIG. 7 shows a relationship between the amount of ink and a Young's modulus. A horizontal axis of the graph shown in FIG. 7 represents the amount of ink. The unit of the amount of ink is picoliter. Pico means $10^{-12}$. pl shown in FIG. 7 means picoliter that is the unit of the amount of ink.

A vertical axis of the graph shown in FIG. 7 represents a Young's modulus. The unit of a Young's modulus is newton per square meter. $N/m^2$ shown in FIG. 7 means newton per square meter that is the unit of a Young's modulus.

$V_L$ shown in FIG. 7 denotes the amount of ink that is applied to each of the first and fourth pixels 122 and 128 shown in FIGS. 5 and 6. $E_L$ shown in FIG. 7 represents the Young's modulus of the fabric 24 in a case in which the amount of ink is $V_L$.

$V_H$ shown in FIG. 7 denotes the amount of ink that is applied to each of the second and third pixels 124 and 126 shown in FIGS. 5 and 6. $E_H$ shown in FIG. 7 represents the Young's modulus of the fabric 24 in a case in which the amount of ink is $V_H$. The amount of ink of each pixel can be derived using image data.

The elastic modulus of the fabric 24 shown in FIG. 5 is calculated using the Young's modulus of the fabric 24 that is derived using the Young's modulus table shown in FIG. 7. The Young's modulus table shown in FIG. 7 is derived for each type of fabric 24 and each type of ink in advance using an experiment, a simulation, or the like.

Young's modulus tables corresponding to each type of fabric 24 and each type of ink may be stored in the table storage section 68 shown in FIG. 2. The image conversion section 66 acquires fabric information including information about the type of the fabric 24 and ink information including information about the type of ink, and reads the Young's modulus table, which is stored in the table storage section 68, on the basis of the type of the fabric 24 and the type of ink.

The fabric information and the ink information may be read from the parameter storage section 80, or may be input using the operation unit 76. The image conversion section 66 derives the Young's modulus of each pixel using the amount of ink of each pixel as a parameter with reference to the read Young's modulus table.

In a case in which the type of warp yarn is different from the type of weft yarn in the fabric 24, the Young's modulus of the fabric 24 in a direction parallel to the warp yarn may be different from the Young's modulus of the fabric 24 in a direction parallel to the weft yarn.

In other words, the stretched length of the fabric 24 in a case in which tension F is applied in a direction parallel to the warp yarn of the fabric 24 may be different from that in a case in which tension F is applied in a direction parallel to the weft yarn of the fabric 24.

Accordingly, as the posture of the fabric 24, it is determined whether the direction of tension F applied to the fabric 24 is parallel to the direction of the warp yarn of the fabric 24 or the direction of tension F applied to the fabric 24 is parallel to the direction of the weft yarn of the fabric 24.

Then, the type of yarn parallel to the direction of the tension F is determined on the basis of information about the posture of the fabric 24. A Young's modulus table corresponding to each type of yarn to be used for the fabric 24 is stored in the table storage section 68 shown in FIG. 2.

The image conversion section 66 selects a Young's modulus table according to the posture of the fabric 24 with reference to a Young's modulus table corresponding to the type of the yarn, and derives a Young's modulus of each pixel. The warp yarn and the weft yarn, which are mentioned here, are two types of yarn of the fabric 24. Yarn, which extends in a random direction, of the two types of yarn of the fabric 24 is warp yarn and yarn thereof extending in a direction crossing the warp yarn is weft yarn.

A Young's modulus E derived for each pixel, the cross-sectional area A of the fabric 24 for each pixel, and the natural length L of each pixel are used to calculate the elastic modulus k of each pixel. The elastic modulus k of each pixel is represented by "k=A×E/L".

The elastic modulus k of each pixel in the above-mentioned equation is a generic name of the elastic modulus $k_1$ and the elastic modulus $k_2$ shown in FIG. 5. The Young's modulus E is a generic name of the Young's modulus of each pixel. The cross-sectional area of the fabric 24 is a generic name of the cross-sectional area for each pixel. The natural length L of the pixel is the entire length of the pixel in the medium transport direction in the unloaded state which is shown in FIG. 5 and in which the tension F is removed.

Hereinafter, a numeral or an alphabet, which represents the number of a pixel, will be attached to the elastic modulus k of each pixel, the Young's modulus E of each pixel, the cross-sectional area A of the fabric 24 for each pixel, and the natural length L of each pixel.

The unit of the elastic modulus k of each pixel in the above-mentioned equation is newton per meter. The unit of the Young's modulus E is newton per square meter. The unit of the cross-sectional area A of the fabric 24 is square meter. The unit of the natural length L of each pixel is meter.

Figure 8:
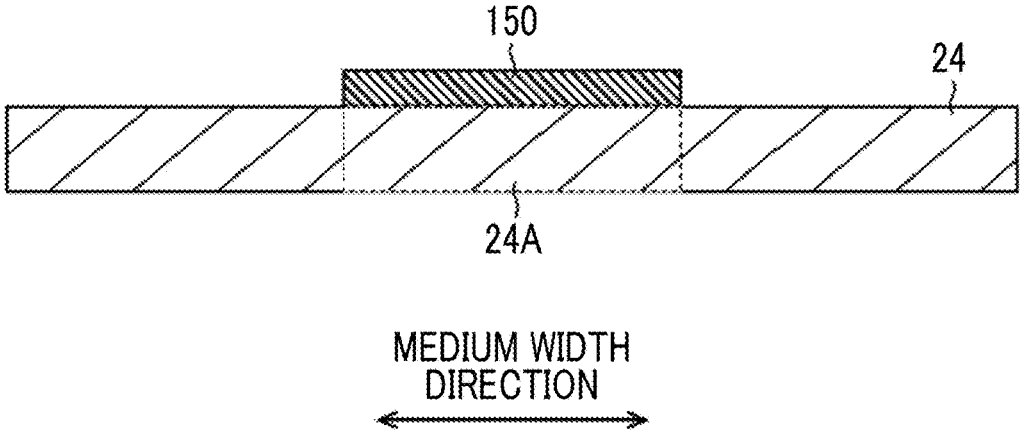
FIG. 8 is a cross-sectional view of a fabric in a state where ink is applied.

FIG. 8 is a cross-sectional view of the fabric in a state where ink is applied. The fabric 24 shown in FIG. 8 corresponds to a cross-sectional view taken along a cutting line extending in a direction parallel to the medium width direction. The cross-sectional area A of the fabric 24 in the above-mentioned equation includes the cross-sectional area of a portion 24A of the fabric 24 which is shown in FIG. 8 and to which ink is applied and the cross-sectional area of ink 150 that is applied to the fabric 24.

<Description of Detection of Tension>

Figure 9:
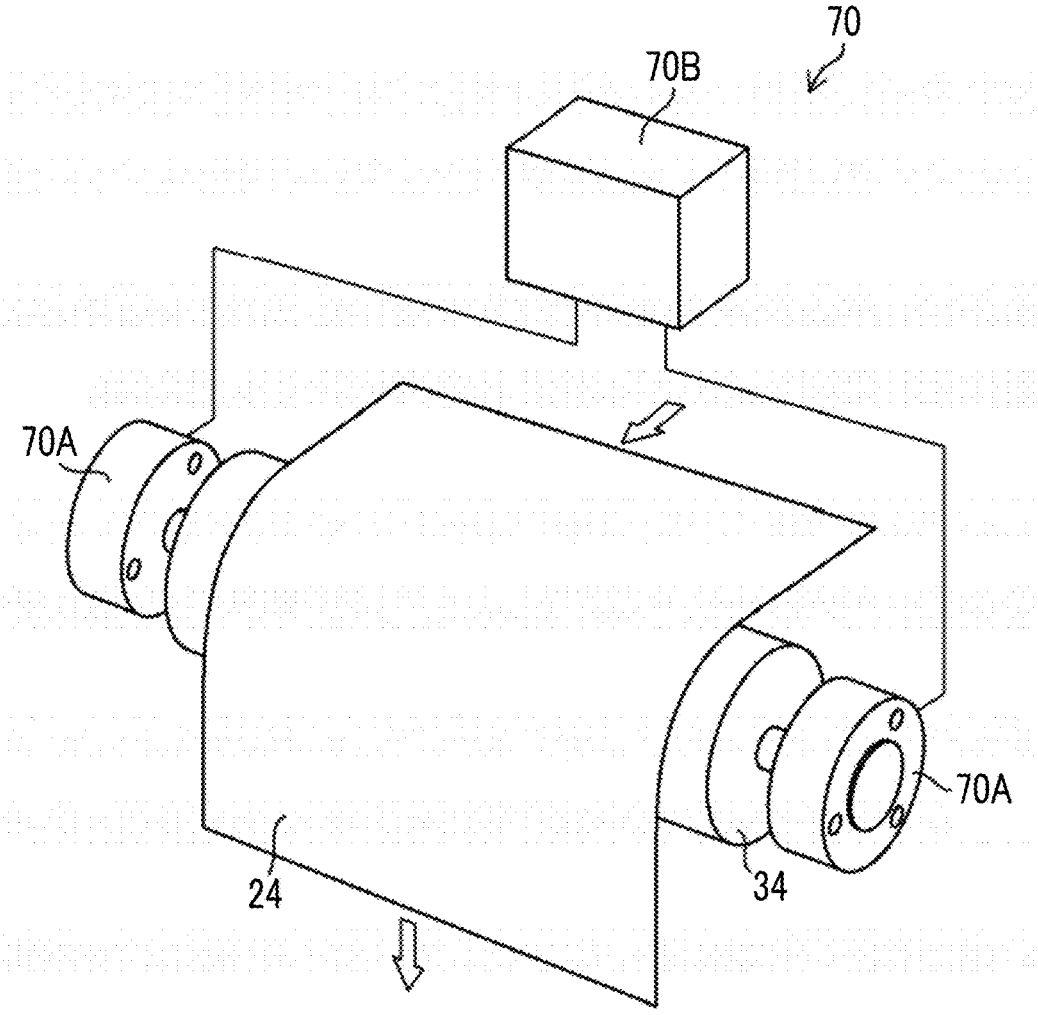
FIG. 9 is a diagram showing an example of the configuration of a tension detection unit.
Figure 10:
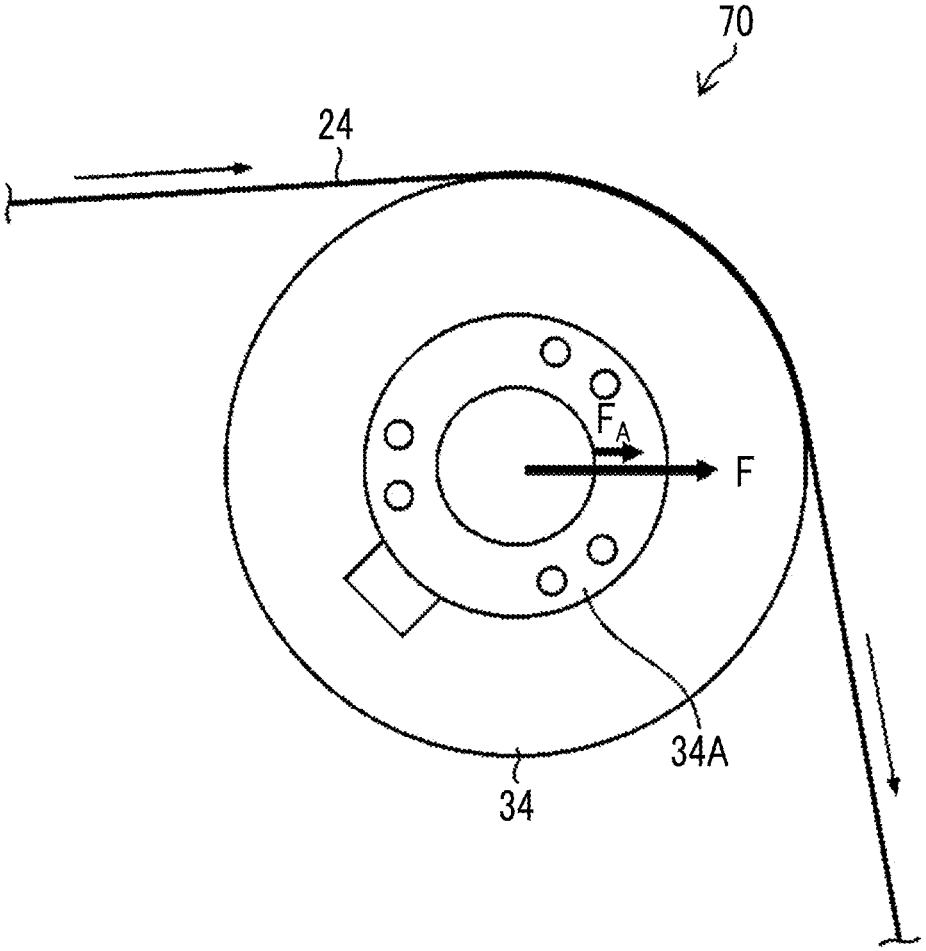
FIG. 10 is a diagram showing the detection of tension.

FIG. 9 is a diagram showing an example of the configuration of the tension detection unit. FIG. 10 is a diagram showing the detection of tension. One end of the tension roller 34 in the longitudinal direction of the tension roller 34 is shown in FIG. 10. The longitudinal direction of the tension roller 34 is a direction parallel to the medium width direction. Further, arrows shown in FIGS. 9 and 10 indicate the transport direction of the fabric 24.

The tension detection unit 70 shown in FIG. 9 comprises tension detection sensors 70A and a signal amplifier 70B. The tension detection sensors 70A are mounted on both ends of the tension roller 34 in the longitudinal direction. A strain gauge can be applied as each tension detection sensor 70A.

The signal amplifier 70B amplifies detection signals that are output from the tension detection sensors 70A. An output signal of the signal amplifier 70B is sent to the system control section 50 shown in FIG. 2. In an aspect where a strain gauge is applied as each tension detection sensor 70A, the signal amplifier 70B converts current signals, which are output from the strain gauges, into voltage signals and converts the voltage signals, which are converted from the current signals, into voltages according to an input circuit of the system control section 50 shown in FIG. 2.

It is difficult for the tension F applied to the fabric 24, which is shown in FIG. 10 and is being transported, to be directly detected. Actually, a load $F_A$ applied to a bearing 34A of the tension roller 34 is measured. The position of the load $F_A$ shown in FIG. 10 is shifted for convenience of illustration.

Further, there is a case where the tension F to be applied to the fabric 24 is not uniformly applied in the width direction of the fabric 24. Accordingly, since tension is detected at both ends of the fabric 24 in the width direction, the tension applied to the fabric 24 can be detected even though the tension to be applied to the fabric 24 is not uniform in the width direction of the fabric 24.

The detection of the tension applied to the fabric 24, which has been described with reference to FIGS. 9 and 10, is illustrative. For example, one of the two tension detection sensors 70A may be omitted in a case in which the transport state of the fabric 24 is stable. Further, a sensor other than a strain gauge may be applied as the tension detection sensor 70A.

<Description of Calculation of Stretched Length>

In a case in which the elastic modulus of each pixel is calculated and the tension F to be applied to the fabric 24 is calculated, the stretched length $\delta_n$ of each pixel is calculated. "n" denotes the identification number of each pixel, and is an integer equal to or larger than 1. The stretched length $\delta_n$ of the n-th pixel is represented by Equation (1).

$$F_n = k_n \times \delta_n \tag{1}$$

$F_n$ of Equation (1) denotes the magnitude of the tension to be applied to the n-th pixel. Since tension having the same magnitude is applied to all pixels, "$F_n$=F" is satisfied. $k_n$ of Equation (1) is the elastic modulus of the n-th pixel.

Equation (1) is modified into Equation (2) that represents the stretched length $\delta_n$ of the n-th pixel.

$$\delta_n = F \times L_n / A_n \times E_n \tag{2}$$

Equation (2) is used to obtain the stretched length $\delta_1$ of the first pixel 122 shown in FIG. 5. In a case in which the tension F to be applied to the fabric 24 is 10 newtons, the natural length $L_1$ of the first pixel 122 is 10 micrometers, the cross-sectional area $A_1$ of the first pixel 122 is $5.2\times10^{-9}$ square meters, and the Young's modulus $E_n$ of the first pixel 122 is $5.0\times10^{9}$ newtons per meter, the stretched length $\delta_1$ of the first pixel 122 is 3.8 micrometers.

The stretched length $\delta_4$ of the fourth pixel 128 and the stretched length $\delta_1$ of the first pixel 122 have the same value.

Further, Equation (2) is used to obtain the stretched length $\delta_{2+3}$ of a composite pixel of the second and third pixels 124 and 126 shown in FIG. 5.

In a case in which the cross-sectional area $A_{2+3}$ of the composite pixel of the second and third pixels 124 and 126 is $5.4\times10^{-9}$ square meters and the Young's modulus $E_n$ of the first pixel 122 is $5.0\times10^{9}$ newtons per meter, the stretched length $\delta_{2+3}$ of the composite pixel of the second and third pixels 124 and 126 is 2.5 micrometers.

<Description of Calculation of Deformation Vector>

Figure 11:
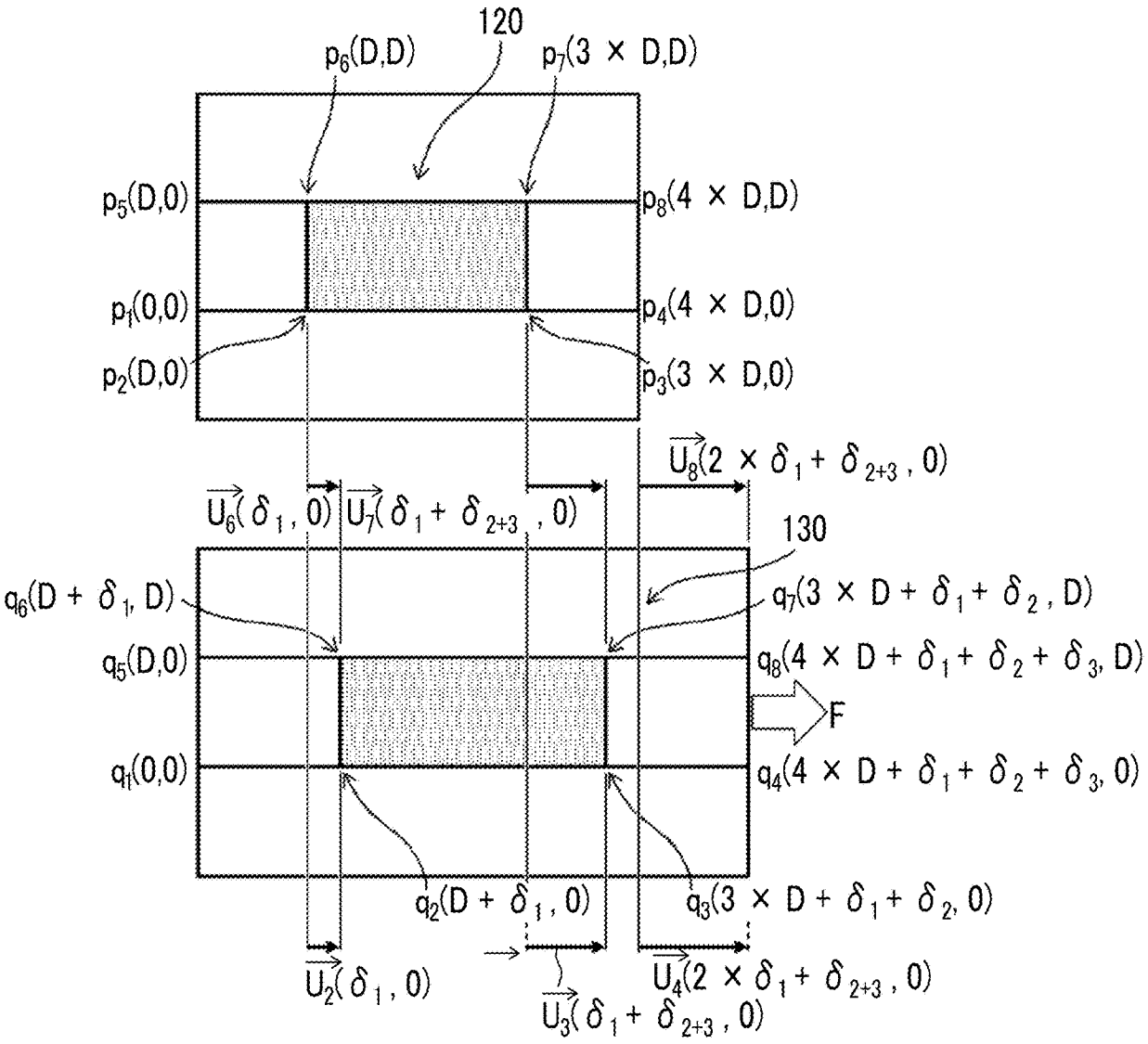
FIG. 11 is a schematic diagram showing the calculation of a deformation vector.

FIG. 11 is a schematic diagram showing the calculation of a deformation vector. An unconverted image 120 and a stretched image 130 shown in FIG. 11 are the same images as the unconverted image 120 and the stretched image 130 shown in FIGS. 5 and 6. Further, first to eighth calculation nodes $p_1$ to $p_8$ in a medium coordinate system shown in FIG. 11 are the same calculation nodes as the first to eighth calculation nodes $p_1$ to $p_8$ in the medium coordinate system shown in FIG. 6.

The first to eighth calculation nodes $p_1$ to $p_8$ of the stretched image 130 shown in FIG. 11 correspond to the first to eighth calculation nodes $p_1$ to $p_8$ set in the unconverted image 120, respectively.

The coordinate value of the first calculation node $q_1$ of the stretched image 130 is calculated by adding a deformation vector $\{U_1\}$ to the coordinate value of the first calculation node $p_1$ of the unconverted image 120. Likewise, the coordinate value of the fifth calculation node $q_5$ of the stretched image 130 is calculated by adding a deformation vector $\{U_5\}$ to the coordinate value of the fifth calculation node $p_5$ of the unconverted image 120.

The deformation vector $\{U_1\}$ and the deformation vector $\{U_5\}$ are represented by Equation (3). The deformation vector $\{U_1\}$ and the deformation vector $\{U_5\}$ are not shown.

$$\{U_1\}=\{U_5\}=(0,0) \tag{3}$$

The coordinate value of the second calculation node $q_2$ of the stretched image 130 shown in FIG. 11 is calculated by adding a deformation vector $\{U_2\}$ to the coordinate value of the second calculation node $p_2$ of the unconverted image 120. Likewise, the coordinate value of the sixth calculation node $q_6$ of the stretched image 130 is calculated by adding a deformation vector $\{U_6\}$ to the coordinate value of the sixth calculation node $p_6$ of the unconverted image 120.

The deformation vector $\{U_2\}$ and the deformation vector $\{U_6\}$ correspond to the deformation vector $\{U_A\}$ shown in FIG. 5.

The deformation vector $\{U_2\}$ and the deformation vector $\{U_6\}$ are represented by Equation (4).

$$\{U_2\}=\{U_6\}=(\delta_1,0) \tag{4}$$

The coordinate value of the third calculation node $q_3$ of the stretched image 130 is calculated by adding a deformation vector $\{U_3\}$ to the coordinate value of the third calculation node $p_3$ of the unconverted image 120. Likewise, the coordinate value of the seventh calculation node $q_7$ of the stretched image 130 is calculated by adding a deformation vector $\{U_7\}$ to the coordinate value of the seventh calculation node $p_7$ of the unconverted image 120.

The deformation vector $\{U_3\}$ and the deformation vector $\{U_7\}$ are represented by Equation (5). Each of the deformation vector $\{U_3\}$ and the deformation vector $\{U_7\}$ corresponds to a vector that is obtained from the addition of the deformation vector $\{U_A\}$ and the deformation vector $\{U_B\}$ shown in FIG. 5.

$$\{U_3\}=\{U_7\}=(\delta_1+\delta_{2+3},0) \tag{5}$$

The coordinate value of the fourth calculation node $q_4$ of the stretched image 130 is calculated by adding a deformation vector $\{U_4\}$ to the coordinate value of the fourth calculation node $p_4$ of the unconverted image 120. Likewise, the coordinate value of the eighth calculation node $q_8$ of the stretched image 130 is calculated by adding a deformation vector $\{U_8\}$ to the coordinate value of the eighth calculation node $p_8$ of the unconverted image 120.

The deformation vector $\{U_4\}$ and the deformation vector $\{U_8\}$ are represented by Equation (6). Each of the deformation vector $\{U_4\}$ and the deformation vector $\{U_8\}$ corresponds to a vector that is obtained from the addition of the deformation vector $\{U_A\}$, the deformation vector $\{U_B\}$, and the deformation vector $\{U_C\}$ shown in FIG. 5.

$$\{U_4\}=\{U_8\}=(2\times\delta_1+\delta_{2+3},0) \tag{6}$$

In a case in which the stretched length $\delta_1$ of the first pixel 122 is 3.8 micrometers and the stretched length $\delta_{2+3}$ of the composite pixel of the second and third pixels 124 and 126 is 2.5 micrometers, the deformation vector $\{U_2\}$ and the deformation vector $\{U_6\}$ are represented by "$\{U_2\}=\{U_6\}=(3.8,0)$". Likewise, the deformation vector $\{U_3\}$ and the deformation vector $\{U_7\}$ are represented by "$\{U_3\}=\{U_7\}=(6.2,0)$".

The deformation vector $\{U_4\}$ and the deformation vector $\{U_8\}$ are represented by Equation (7).

$$\{U_4\}=\{U_8\}=(10.0,0) \tag{7}$$

The unit of a numerical value, which represents the component of each coordinate vector, is micrometer.

In the conversion of the unconverted image 120 shown in FIG. 11 into the stretched image 130, a vector arithmetic operation, which is represented by Equation (8), is performed at each calculation node shown in FIG. 11.

$$\{Q_n\}=\{P_n\}+\{U_n\} \tag{8}$$

Here, $\{P_n\}$ denotes a vector that is directed to an n-th calculation node $p_n$ from any origin in the medium coordinate system. Further, $\{Q_n\}$ denotes a vector that is directed to an n-th calculation node $q_n$ from an origin set in the medium coordinate system.

In a case in which the stretched length $\delta_1$ of the first pixel 122 is 3.8 micrometers and the stretched length $\delta_{2+3}$ of the composite pixel of the second and third pixels 124 and 126 is 2.5 micrometers, a vector $\{Q_n\}$, which represents each calculation node $q_n$ in the monitor coordinate system, is represented by each of Equations (9) to (16) to be described below. The unit of a numerical value, which represents the component of the vector $\{Q_n\}$, is micrometer.

$$\{Q_1\}=\{P_1\}+\{U_1\}=(0,0) \tag{9}$$

$$\{Q_2\}=\{P_2\}+\{U_2\}=(13.8,0) \tag{10}$$

$$\{Q_3\}=\{P_3\}+\{U_3\}=(36.3,0) \tag{11}$$

$$\{Q_4\}=\{P_4\}+\{U_4\}=(50.1,0) \tag{12}$$

$$\{Q_5\}=\{P_5\}+\{U_5\}=(0,10.0) \tag{13}$$

$$\{Q_6\}=\{P_6\}+\{U_6\}=(13.8,10.0) \tag{14}$$

$$\{Q_7\}=\{P_7\}+\{U_7\}=(36.3,10.0) \tag{15}$$

$$\{Q_8\}=\{P_8\}+\{U_8\}=(50.1,10.0) \tag{16}$$

The coordinate value of each calculation node $q_n$ in the medium coordinate system, which is calculated in this way, is converted into a coordinate value in the monitor coordinate system, so that converted image data representing a converted image is generated.

<Description of Pixel of Converted Image>

Figure 12:
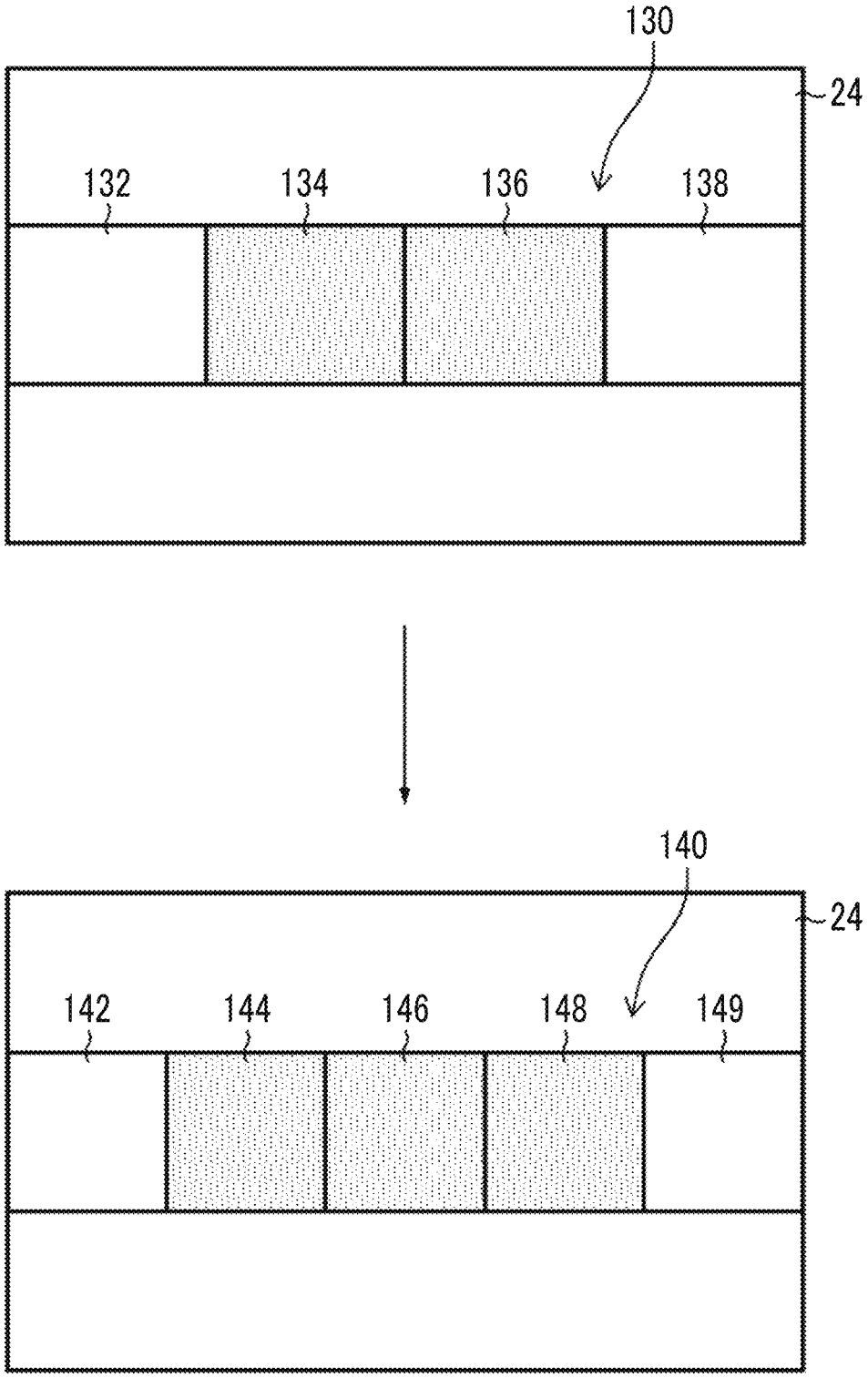
FIG. 12 is a diagram showing pixels of a converted image.

FIG. 12 is a diagram showing pixels of a converted image. FIG. 12 schematically shows an association between each stretched pixel of the stretched image 130 and each pixel of a converted image 140.

The converted image 140 shown in FIG. 12 includes five pixels, that is, a first pixel 142, a second pixel 144, a third pixel 146, a fourth pixel 148, and a fifth pixel 149. The respective pixels of the converted image 140 do not correspond to the respective stretched pixels of the stretched image 130 one to one.

For example, color information about the second pixel 144 of the converted image 140 includes color information about the first stretched pixel 132 of the stretched image 130 and color information about the second stretched pixel 134.

In a case in which color information about each pixel of the converted image 140 includes color information about a plurality of stretched pixels of the stretched image 130, a weighted average value of color information about the plurality of stretched pixels of the stretched image 130 can be applied as color information about each pixel of the converted image 140. The weighted average value of color information about the plurality of stretched pixels is one aspect of color information that is an average of color information about a plurality of deformed pixels.

In a case in which the area ratio of the first stretched pixel 132 of the stretched image 130 is 38% and the area ratio of the second stretched pixel 134 is 62% in the second pixel 144 of the converted image 140, color information about the second pixel 144 of the converted image 140 is represented by Equation (17).

$$0.38\times(C_L,M_L,Y_L,K_L)+0.62\times(C_H,M_H,Y_H,K_H)=(0.38\times C_L+0.62\times C_H,0.38\times M_L+0.62\times M_H,0.38\times Y_L+0.62\times Y_H,0.38\times K_L+0.62\times K_H) \tag{17}$$

$C_L$, $M_L$, $Y_L$, and $K_L$ of Equation (17) are color information about the first stretched pixel 132 of the stretched image 130. $C_H$, $M_H$, $Y_H$, and $K_H$ are color information about the second stretched pixel 134 of the stretched image 130.

Likewise, in a case in which the area ratio of the third stretched pixel 136 of the stretched image 130 is 62% and the area ratio of the fourth stretched pixel 138 is 38% in the fourth pixel 148 of the converted image 140, color information about the fourth pixel 148 of the converted image 140 is represented by Equation (18).

$$0.38\times(C_H,M_H,Y_H,K_H)+0.62\times(C_L,M_L,Y_L,K_L)=(0.38\times C_H+0.62\times C_L,0.38\times M_H+0.62\times M_L,0.38\times Y_H+0.62\times Y_L,0.38\times K_H+0.62\times K_L) \quad (18)$$

$C_H$, $M_H$, $Y_H$, and $K_H$ of Equation (18) are color information about the third stretched pixel 136 of the stretched image 130. $C_L$, $M_L$, $Y_L$, and $K_L$ are color information about the second stretched pixel 134 of the stretched image 130.

Color information about the first stretched pixel 132 of the stretched image 130 is applied as color information about the first pixel 142 of the converted image 140. Color information about the second stretched pixel 134 and the third stretched pixel of the stretched image 130 is applied as color information about the third pixel 146 of the converted image 140. Color information about the fourth stretched pixel 138 of the stretched image 130 is applied as color information about the fifth pixel 149 of the converted image 140.

In a case in which color information about each pixel of the converted image 140 includes color information about a plurality of stretched pixels of the stretched image 130, color information about the stretched pixel where the area ratios of a plurality of stretched pixels of the stretched image 130 are high in the respective pixels of the converted image 140 may be used as color information about each pixel of the converted image 140.

A converted image in which color information of original image data is maintained can be generated in this way.

Description of Modification Example

Figure 13:
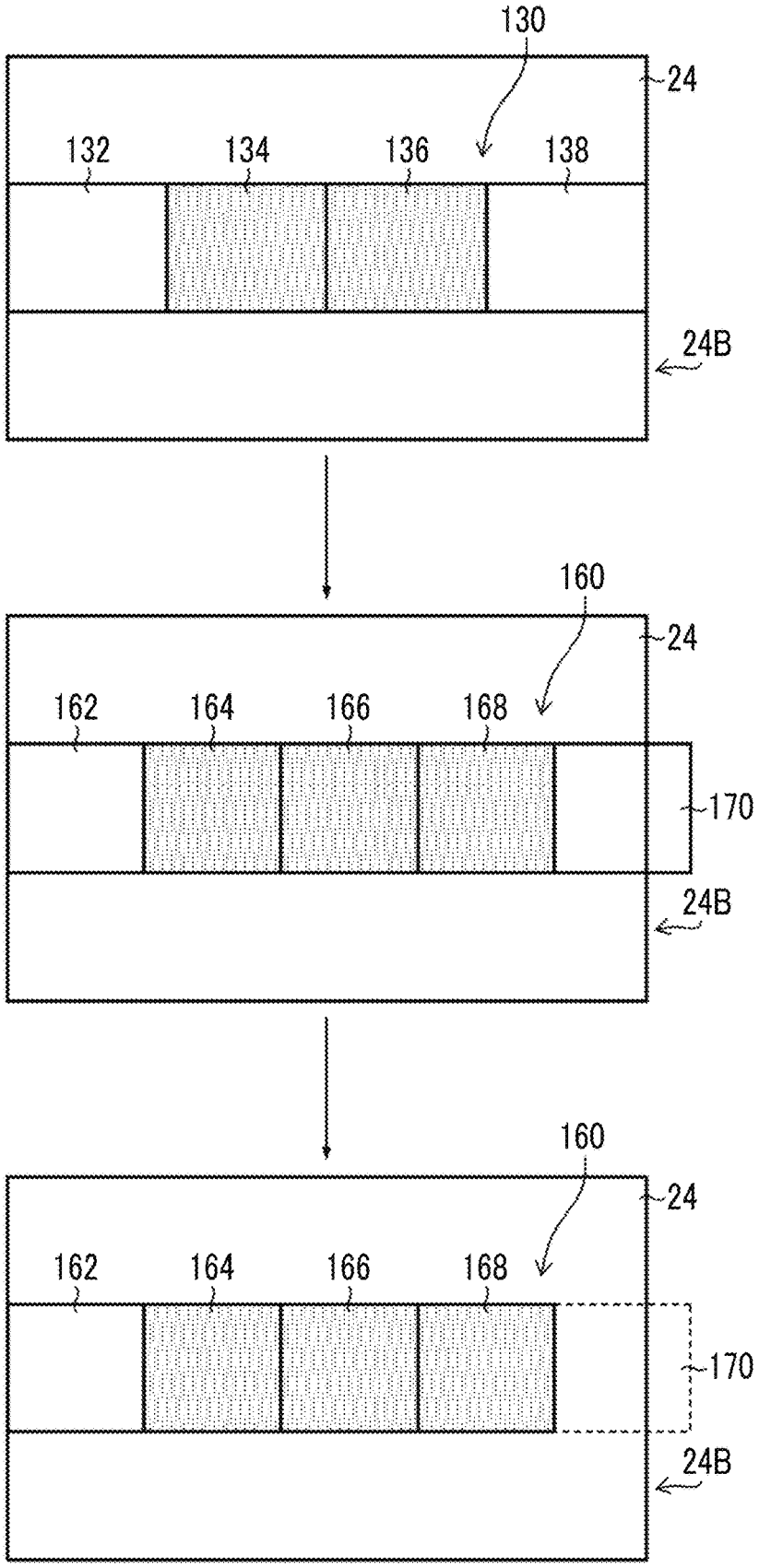
FIG. 13 is a diagram showing a modification example of image conversion processing.

FIG. 13 is a diagram showing a modification example of the image conversion processing. In a case in which each stretched pixel of the stretched image 130 is assigned, a fifth pixel 170 of a converted image 160 corresponds to a fraction. In a case in which a pixel corresponding to a fraction is generated, the fifth pixel 170 corresponding to a fraction is deleted and the converted image 160 includes four pixels, that is, a first pixel 162, a second pixel 164, a third pixel 166, and a fourth pixel 168.

A blank space is formed between the fourth pixel 168 and a distal end 24B of the fabric 24, but the length of the blank space in the medium transport direction is less than the length of one pixel in the medium transport direction and it is difficult for the blank space to be visually recognized.

Further, since color information about the third stretched pixel 136 of the stretched image 130 and color information about the fourth stretched pixel 138 are considered in regard to the fourth pixel 168 of the converted image 160, it is difficult for the omission of the fifth pixel 170 to be visually recognized.

A converted image in which information about a pixel of original image data is maintained can be generated in this way.

<Description of Procedure of Image Forming Method>

Figure 14:
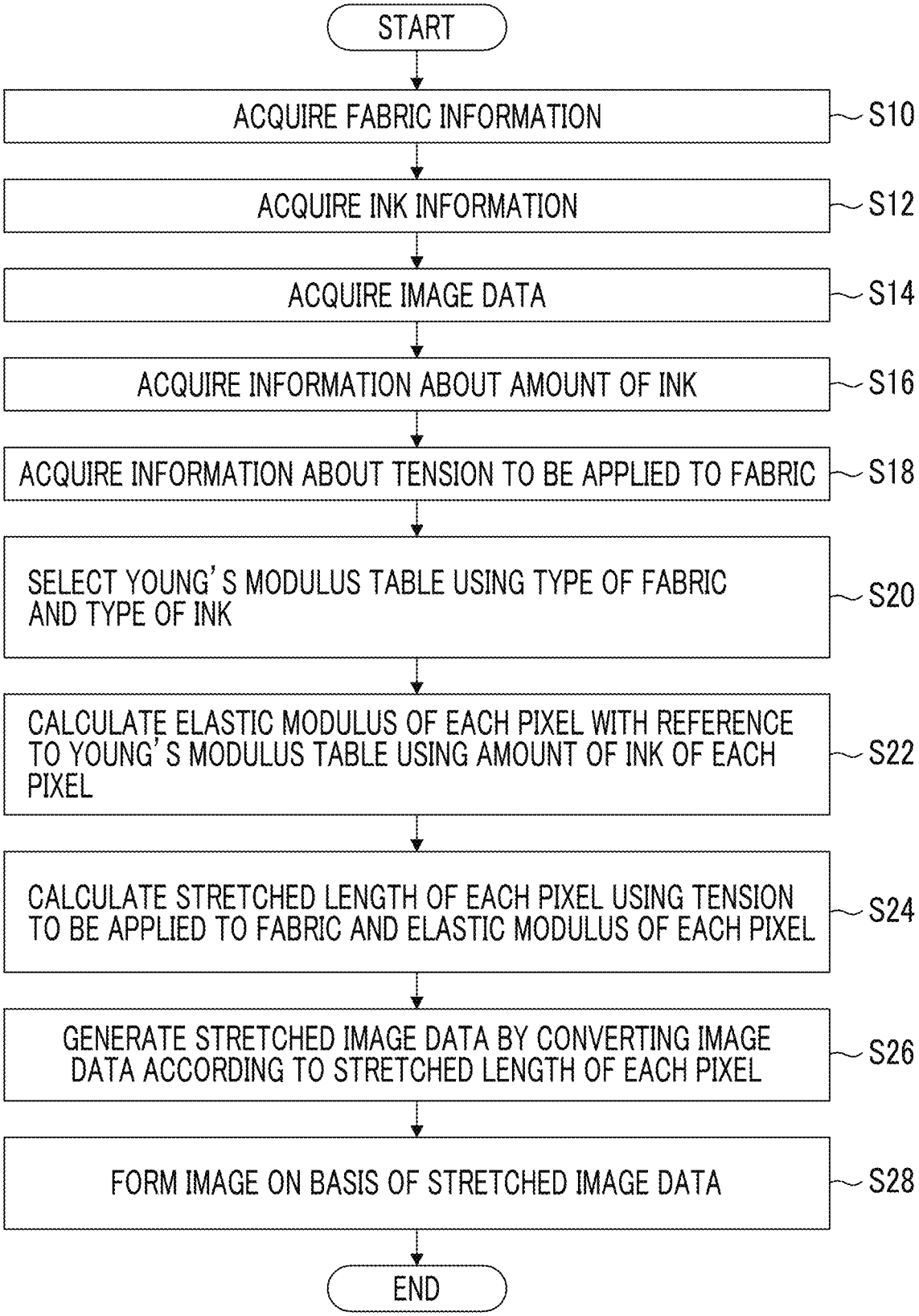
FIG. 14 is a flowchart showing the flow of an image forming method according to the first embodiment.

FIG. 14 is a flowchart showing the flow of an image forming method according to the first embodiment. In a case in which image formation is started, fabric information including information about the type of the fabric 24 shown in FIG. 1 is acquired in a fabric information acquisition step S10.

After the fabric information is acquired in the fabric information acquisition step S10, processing proceeds to an ink information acquisition step S12. Ink information including the type of ink is acquired in the ink information acquisition step S12. After the ink information is acquired in the ink information acquisition step S12, processing proceeds to an image data acquisition step S14.

Image data is acquired in the image data acquisition step S14. After the image data is acquired in the image data acquisition step S14, processing proceeds to an ink amount-information acquisition step S16. In the ink amount-information acquisition step S16, information about the amount of ink of each pixel is acquired using the image data. The ink amount-information acquisition step S16 is one aspect of an image forming liquid-application amount-information acquisition step.

After the information about the amount of ink of each pixel is acquired in the ink amount-information acquisition step S16, processing proceeds to a tension information acquisition step S18. Information about tension to be applied to the fabric 24, which is detected by the tension detection unit 70 shown in FIG. 2, is acquired in the tension information acquisition step S18. The tension information acquisition step S18 is one aspect of a tension information acquisition step.

The information about tension to be applied to the fabric 24, which is acquired in the tension information acquisition step S18, is preferably detected in a state where the stretched image 130 shown in FIG. 11 is formed on the fabric 24.

However, since image data representing the stretched image 130 is not yet generated when the tension information acquisition step S18 is performed, it is difficult to detect the tension to be applied to the fabric 24 on which the stretched image 130 is formed.

Accordingly, it is assumed that tension to be applied to the fabric 24 on which the stretched image 130 is not formed is substantially the same as tension to be applied to the fabric 24 on which the stretched image 130 is formed, and the tension to be applied to the fabric 24 on which the stretched image 130 is not formed is detected instead of the tension to be applied to the fabric 24 on which the stretched image 130 is formed.

The tension to be applied to the fabric 24 on which the stretched image 130 is not formed may be corrected on the basis of a correction coefficient that is derived in advance using an experiment, a simulation, or the like in regard to the tension to be applied to the fabric 24 on which the stretched image 130 is not formed.

It is preferable that the correction coefficient to be used for the detection of tension is derived for each type of fabric 24 and each type of ink.

After the information about the tension to be applied to the fabric 24 is acquired in the tension information acquisition step S18, processing proceeds to a Young's modulus table selection step S20. In the Young's modulus table selection step S20, a Young's modulus table is selected using the fabric information acquired in the fabric information acquisition step S10 and the ink information acquired in the ink information acquisition step S12.

After a Young's modulus table is selected in the Young's modulus table selection step S20, processing proceeds to an elastic modulus calculation step S22. In the elastic modulus calculation step S22, a Young's modulus of each pixel is derived with reference to the selected Young's modulus table using the information about the amount of ink of each pixel acquired in the ink amount-information acquisition step S16.

An elastic modulus of each pixel is calculated using the derived Young's modulus of each pixel and the information about the amount of ink of each pixel acquired in the ink amount-information acquisition step S16. After the elastic modulus of each pixel is calculated in the elastic modulus calculation step S22, processing proceeds to a stretched length calculation step S24. The elastic modulus calculation step S22 is one aspect of an elastic modulus acquisition step.

In the stretched length calculation step S24, the stretched length of each pixel is calculated using the information about tension to be applied to the fabric 24 that is acquired in the tension information acquisition step S18 and the elastic modulus of each pixel that is calculated in the elastic modulus calculation step S22.

After the stretched length of each pixel is calculated in the stretched length calculation step S24, processing proceeds to an image conversion step S26. In the image conversion step S26, image data representing the unconverted image 120 shown in FIG. 11 is converted into image data representing the stretched image 130. The stretched length calculation step S24 is one aspect of a medium deformation amount-calculation step.

Moreover, in the image conversion step S26 shown in FIG. 14, the image data representing the stretched image 130 shown in FIG. 11 is converted into image data representing the converted image 140 shown in FIG. 12. Image data representing the converted image 160 shown in FIG. 13 may be generated in the image conversion step S26 shown in FIG. 14.

After the image data representing the converted image 140 shown in FIG. 12 or the image data representing the converted image 160 shown in FIG. 13 is formed in the image conversion step S26 shown in FIG. 14, processing proceeds to an image forming step S28 shown in FIG. 14.

In the image foaming step S28, an image is formed on the fabric 24 by the ink jet heads 40C, 40M, 40Y, and 40K shown in FIG. 1 on the basis of the image data representing the converted image 140 shown in FIG. 12 or the image data representing the converted image 160 shown in FIG. 13 that is generated in the image conversion step S26. In the image forming step S28 shown in FIG. 14, dots are formed on the fabric 24 at the positions corresponding to pixels of the converted image data by the ink jet heads 40C, 40M, 40Y, and 40K shown in FIG. 1.

After the image is formed in the image conversion step S26 shown in FIG. 14, the image foaming method ends.

[Modification Example of Calculation of Elastic Modulus]

An elastic modulus is calculated for each pixel in this embodiment, but the unit of calculation of an elastic modulus is not limited to each pixel. An image is diagnosed with a finite element model including a plurality of spring elements, and it is possible to cope with a complicated model using finite element calculation or the like.

Figure 15:
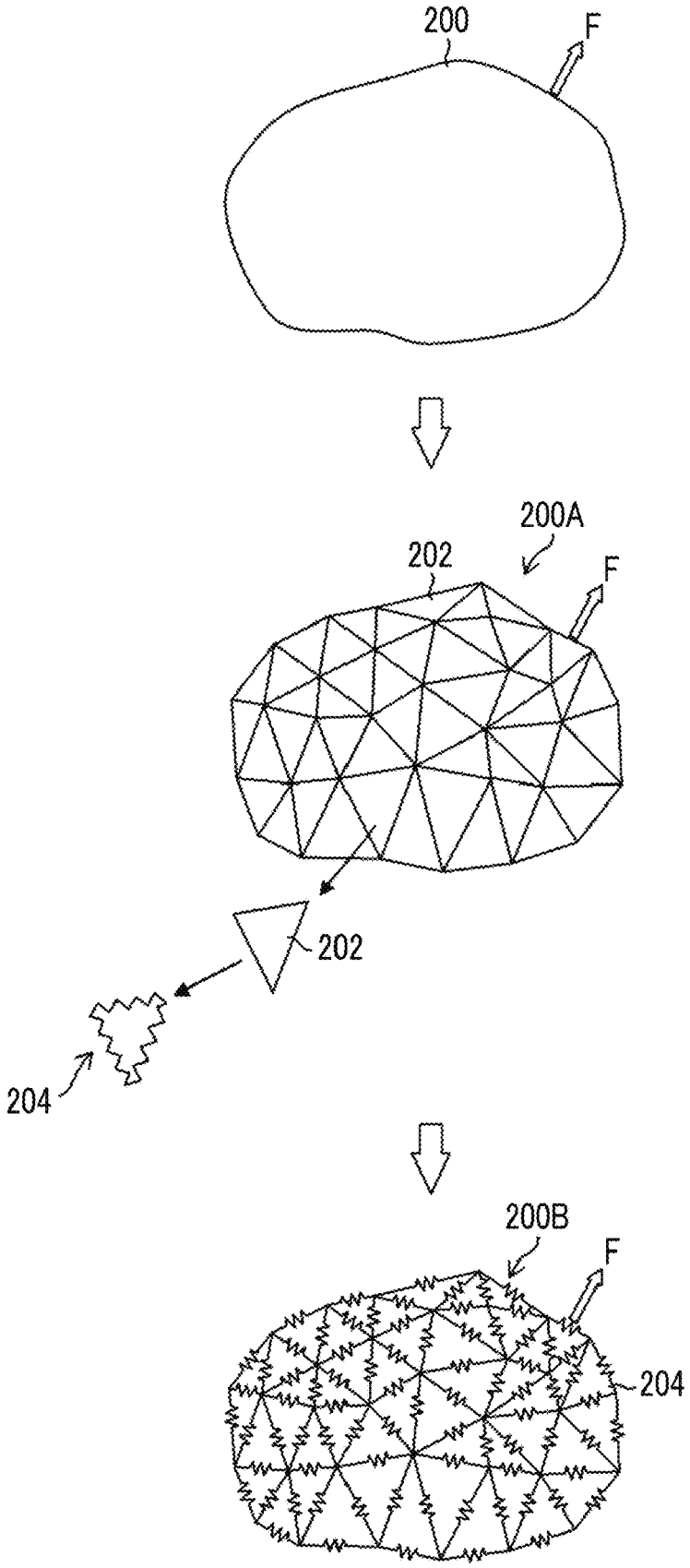
FIG. 15 is a diagram showing finite element calculation.

FIG. 15 is a diagram showing finite element calculation. The image 102 shown in FIG. 3 and the unconverted image 120 shown in FIG. 5 and the like are replaced with a continuous body 200 shown in FIG. 15. The continuous body 200 is subjected to shape approximation, and is replaced with an aggregate 200A of a plurality of finite elements 202.

Each finite element 202 is subjected to characteristic approximation, and is replaced with a simple spring element 204. The aggregate 200A of the plurality of finite elements 202 is replaced with an aggregate 200B of a plurality of spring elements 204. The aggregate 200B of the plurality of spring elements 204 is used as a calculation model.

In a case in which a tension vector to be applied to each calculation node is denoted by {F}, the stiffness matrix of the entire calculation model is denoted by [K], and a deformation vector of each calculation node is denoted by {U}, the tension vector {F} to be applied to each calculation node is represented by Equation (19).

$$\{F\}=[K]\times\{U\} \tag{19}$$

Equation (19) corresponds to Equation (1). In Equation (1), the tension vector {F} to be applied to each calculation node is the tension F to be applied to the fabric 24 over all the pixels.

Equation (19) can be modified into Equation (20) that represents {U}.

$$\{U\}=[K]^{-1}\times\{F\} \tag{20}$$

A calculation node {Q} in a state where tension is applied is represented by Equation (21) using the deformation vector {U} of each calculation node, which is derived using Equation (20), and each calculation node {P} in the unloaded state where the tension is removed.

$$\{Q\}=\{P\}+\{U\} \tag{21}$$

Equation (21) corresponds to Equation (8).

That is, an aspect in which calculation nodes are set for each pixel is exemplified in FIG. 6. However, an image may be divided into a plurality of sub-regions each of which includes at least one pixel, calculation nodes may be set for each sub-region, and Equation (21) may be applied to each of the calculation nodes.

The sub-region may be determined on the basis of the amount of ink. The sub-region may be determined on the basis of a Young's modulus.

[Description of Example of the Structure of Ink Jet Head]

Figure 16:
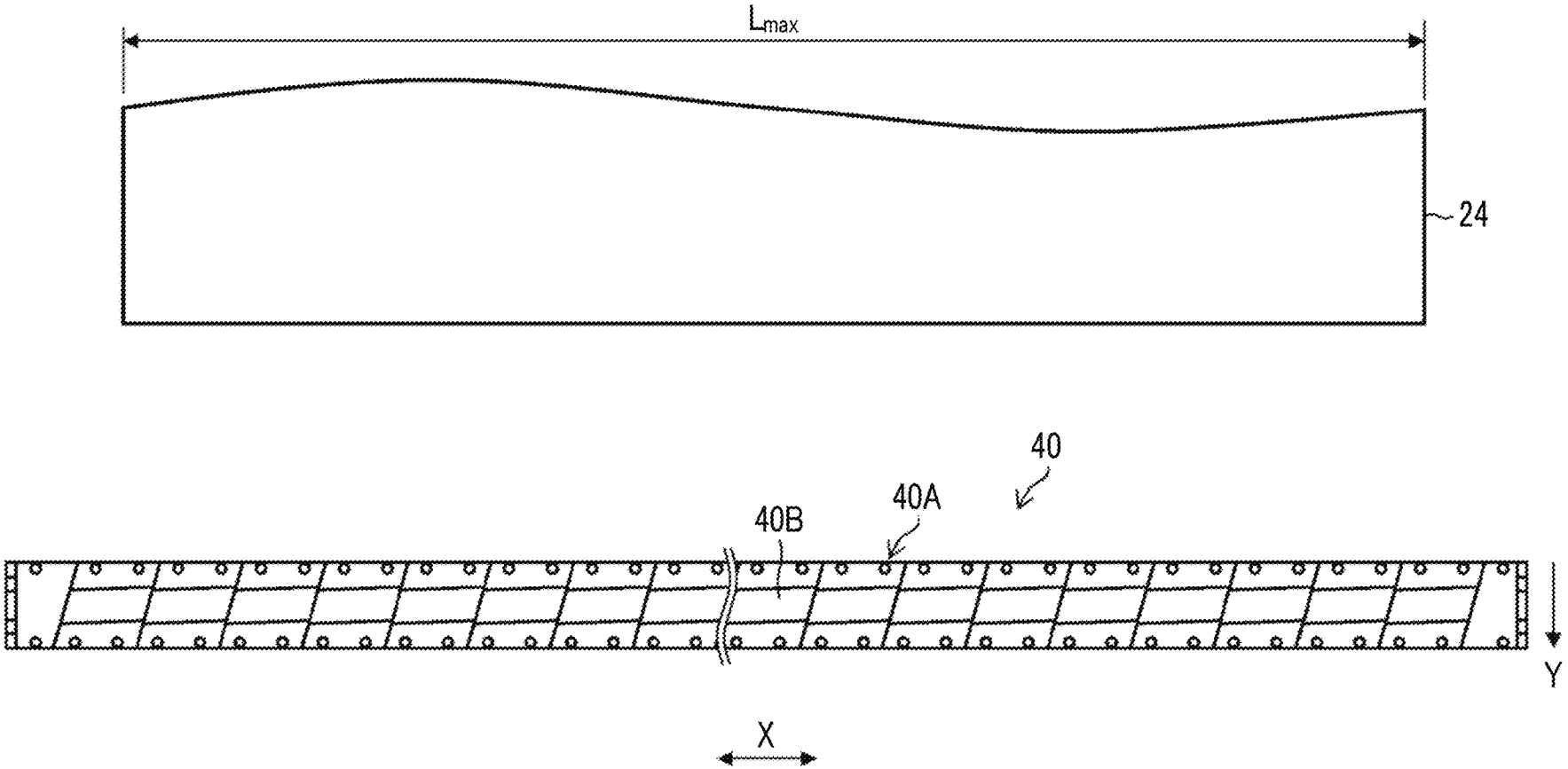
FIG. 16 is a perspective plan view showing an example of the structure of an ink jet head.

FIG. 16 is a perspective plan view showing an example of the structure of the ink jet head. The ink jet head 40 shown in FIG. 16 is a full-line type head having a structure in which a plurality of jetting elements are arranged in the medium width direction over a length equal to or longer than the entire length of the fabric 24.

The medium width direction is denoted in FIG. 16 by reference character X. Further, the medium transport direction is denoted by reference character Y. Reference character $L_{max}$ denotes the entire length of the fabric 24 in the medium width direction.

The ink jet head 40 shown in FIG. 16 has a structure in which a plurality of head modules 40A are connected in the medium width direction. Reference numeral 40B denotes a jetting opening-forming surface on which a jetting opening of each jetting element is formed.

A serial type head may be applied instead of a full-line type head. The serial type head has a structure in which a plurality of jetting elements are arranged in the medium transport direction. Further, the serial type head is mounted on a carriage that moves the serial type head in the medium width direction.

The serial type head is moved in the medium width direction, so that an image is formed in a region corresponding to a length along which recording elements are arranged in the medium transport direction. After one time of image formation ends, the fabric 24 is transported in the medium transport direction by a certain distance and an image is formed in the next region.

This operation is repeated, so that an image is formed in the entire region of the fabric 24 in which an image is to be formed. The serial type head is not shown.

The jetting element includes a jetting opening, a flow passage, and a pressure generating element. A piezoelectric element can be applied as the pressure generating element. A heater can be applied as the pressure generating element. That is, a piezoelectric system or a thermal system may be applied as a jet system of the ink jet head 40. Various systems, such as an electrostatic system, may be applied as the jet system of the ink jet head 40.

Effects of First Embodiment

According to the ink jet recording apparatus 10 having the above-mentioned configuration and the image forming apparatus, in the conversion of image data according to the deformation of the fabric 24, the elastic modulus of each pixel is calculated according to the amount of ink to be applied to the fabric 24 and the stretched length of each pixel is calculated using the elastic modulus of each pixel. Accordingly, an image, which is made in consideration of the stretched length of each pixel caused by a difference in the amount of ink, is formed.

Even in a case in which local deformation occurs in an image or non-linear deformation occurs in an image as a whole due to the calculation of an elastic modulus and the calculation of the amount of deformation that are performed for each pixel or each sub-region, a converted image corresponding to the deformation of the image can be generated.

An aspect in which a plurality of pixels having the same amount of ink and adjacent to each other are handled as one pixel has been exemplified in this embodiment, but a plurality of pixels having the same Young's modulus may be handled as one pixel.

Second Embodiment

Next, an image forming apparatus and an image forming method according to a second embodiment will be described. The difference of the second embodiment from the first embodiment will be mainly described in the description of the second embodiment. The description of the same components as the components of the first embodiment will be appropriately omitted in the second embodiment.

<Overall Configuration of Image Forming Apparatus>

Figure 17:
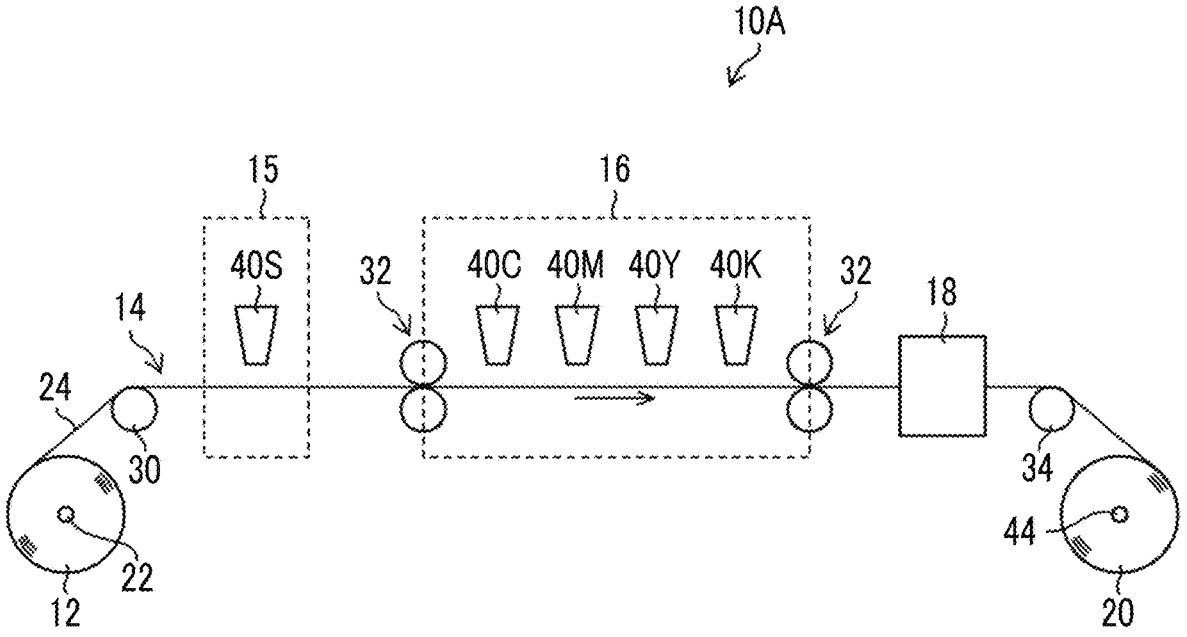
FIG. 17 is a diagram showing the overall configuration of an image forming apparatus according to a second embodiment.

FIG. 17 is a diagram showing the overall configuration of the image forming apparatus according to the second embodiment. The ink jet recording apparatus 10A shown in FIG. 17 includes a pretreatment section 15 shown in FIG. 17 in addition to the ink jet recording apparatus 10 shown in FIG. 1. The pretreatment section 15 comprises a treatment liquid head 40S.

The treatment liquid head 40S applies treatment liquid to an image forming surface of a fabric 24 by an ink jet system. The same structure as the structure of each of the ink jet heads 40C, 40M, 40Y, and 40K of the image forming unit 16 can be applied to the treatment liquid head 40S.

The pretreatment section 15 may include a treatment liquid application device instead of the treatment liquid head 40S. A roller application system including an application roller, a spray system including a spray nozzle, or the like can be applied as an application system of the treatment liquid application device. The treatment liquid head 40S is one aspect of a treatment liquid application unit.

The treatment liquid has a function to aggregate or insolubilize a color material contained in ink. Since an image is formed in a region to which the treatment liquid is applied, the bleeding of ink applied to the fabric 24 is suppressed. The treatment liquid is one aspect of image forming liquid.

In a case in which color paste having been used in a textile printing method in the related art is used in the image formation on the fabric 24 using an ink jet system, nozzle clogging tends to be caused in the ink jet head. Accordingly, treatment liquid is applied to the fabric 24 in advance. The treatment liquid may be referred to as a paste solution.

The treatment liquid contains paste, a solvent, and a hydrotropic agent. The same paste as paste used in other textile printing, such as screen textile printing, can be applied as the paste. It is preferable that a water-soluble solvent is used as the solvent. It is most preferable that a solvent including at least water is used.

Generally, the hydrotropic agent functions to increase the color optical density of an image in a case in which the fabric 24 to which ink is applied is heated in steam. Examples of the hydrotropic agent include urea, alkyl urea, ethylene urea, propylene urea, thiourea, guanidine hydrochloride, tetraalkylarnmonium halide, and the like.

Further, a publicly known hydrotropic agent can be used. It is preferable that a hydrotropic agent content based on the entire solid content of the treatment liquid is in the range of 0.01 percentages by mass to 20 percentages by mass.

The treatment liquid may further contain aqueous metal salt, water-soluble metal salt, or a pH adjuster, a water repellent agent, a surfactant, a migration inhibitor, a microporous former, and the like as necessary.

In a case in which a pad method is applied to the application of treatment liquid, it is preferable that the treatment liquid is patted at a squeezing rate in the range of 5% to 150%. It is more preferable that the treatment liquid is patted at a squeezing rate in the range of 10% to 130%. The treatment liquid may be included in the image forming liquid.

A treatment liquid-drying treatment section not shown in FIG. 17 is disposed at a position on the downstream side of the pretreatment section 15 and on the upstream side of the image forming unit 16 in the medium transport direction. The treatment liquid-drying treatment section performs drying treatment on the treatment liquid applied to the fabric 24. Examples of the drying treatment include heating treatment using a heating device and blast treatment using a blast device.

<Schematic Configuration of Control System>

Figure 18:
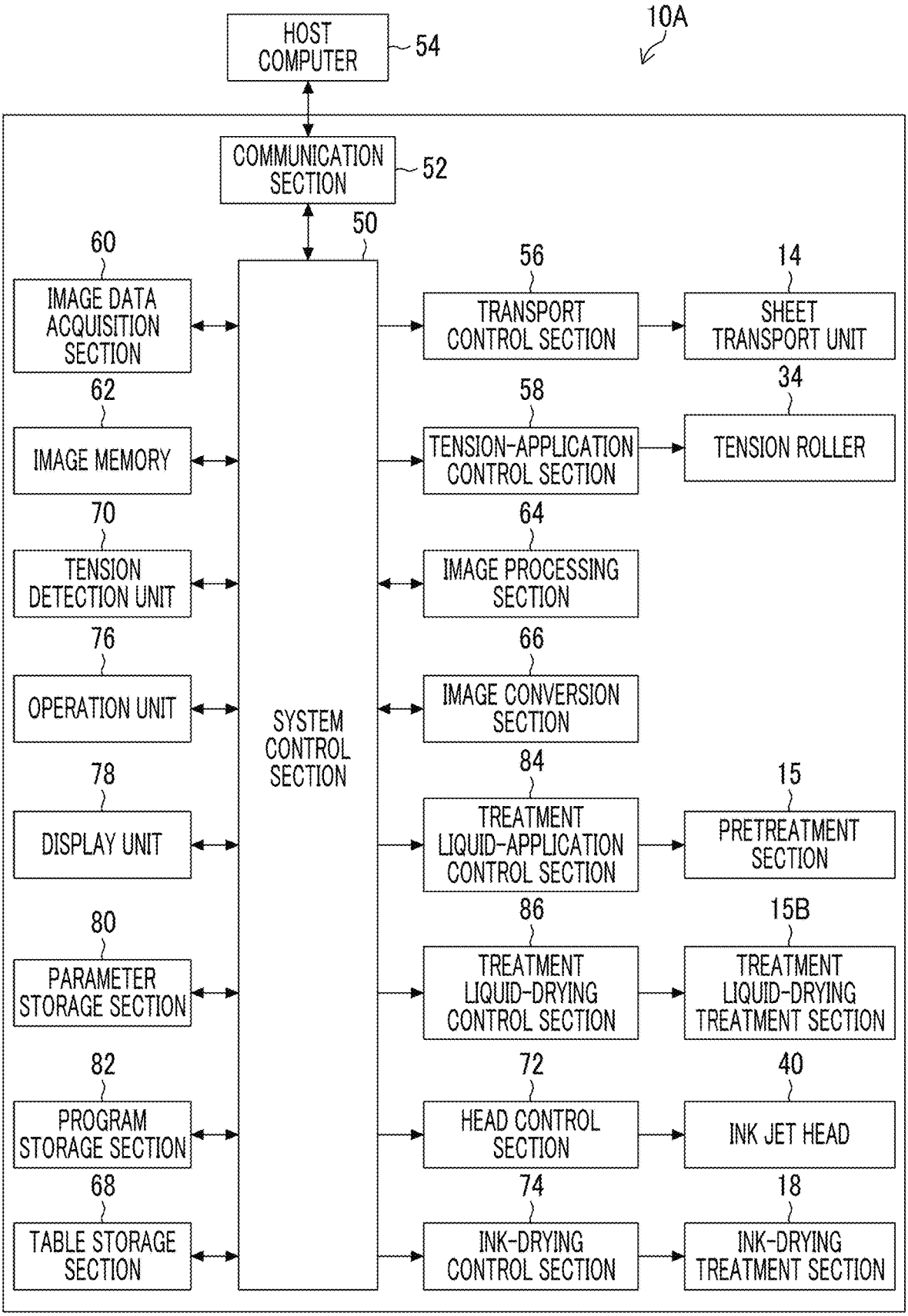
FIG. 18 is a block diagram showing the schematic configuration of a control system of the image forming apparatus shown in FIG. 17.

FIG. 18 is a block diagram showing the schematic configuration of a control system of the image forming apparatus shown in FIG. 17. The control system of the ink jet recording apparatus 10A shown in FIG. 18 comprises a treatment liquid-application control section 84 and a treatment liquid-drying control section 86 shown in FIG. 18 in addition to the control system of the ink jet recording apparatus 10 shown in FIG. 2.

The treatment liquid-application control section 84 controls the operation of the pretreatment section 15 on the basis of image data that is acquired through the image data acquisition section 60. The treatment liquid-application control section 84 controls the operation start timing of the pretreatment section 15, the operation stop timing of the pretreatment section 15, and the amount of treatment liquid to be applied. The pretreatment section 15 may be referred to as a treatment liquid head 40S.

The treatment liquid-drying control section 86 controls the operation of a treatment liquid-drying treatment section 15B on the basis of a command that is sent from the system control section 50. The treatment liquid-drying control section 86 controls the operation start timing of the treatment liquid-drying treatment section 15B, the operation stop timing of the treatment liquid-drying treatment section 15B, and the treatment temperature of the treatment liquid-drying treatment section 15B.

<Action of Image Forming Apparatus>

The same effects as the effects of the ink jet recording apparatus 10 shown in FIGS. 1 and 2 are obtained from the ink jet recording apparatus 10A shown in FIGS. 17 and 18. Further, in the ink jet recording apparatus 10A shown in FIGS. 17 and 18, treatment liquid is applied to a region of the fabric 24 in which an image is to be formed before the image is formed by the image forming unit 16.

The treatment liquid applied to the fabric 24 is dried by the treatment liquid-drying treatment section 15B. That is, a treatment liquid layer is formed in a region in which an image is to be formed on the fabric 24 on which the image is not yet formed.

The image forming unit 16 forms an image on the fabric 24 where the treatment liquid layer is formed in the region in which the image is to be formed. Since the image is formed in the region to which the treatment liquid is applied, the bleeding of the image is suppressed.

[Detailed Description of Image Conversion Processing]

<Overview of Image Conversion Processing>

Image conversion processing applied to the ink jet recording apparatus 10A shown in FIGS. 17 and 18 is different from that of the ink jet recording apparatus 10 shown in FIGS. 1 and 2 in terms of the selection of a Young's modulus table and the derivation of a Young's modulus. The selection of a Young's modulus table and the derivation of a Young's modulus will be described in detail below.

<Description of Selection of Young's Modulus Table>

A Young's modulus of each pixel differs depending on the type of treatment liquid to be used and the amount of treatment liquid of each pixel. A Young's modulus table is made for each of the type of fabric 24, the type of ink, and the type of treatment liquid.

The type of fabric 24, the type of ink, and the type of treatment liquid are used in a case in which a Young's modulus table is to be selected. Treatment liquid information, which includes the type of treatment liquid, may be read from the parameter storage section 80, or may be input using the operation unit 76.

<Example of Young's Modulus Table>

Figure 19:
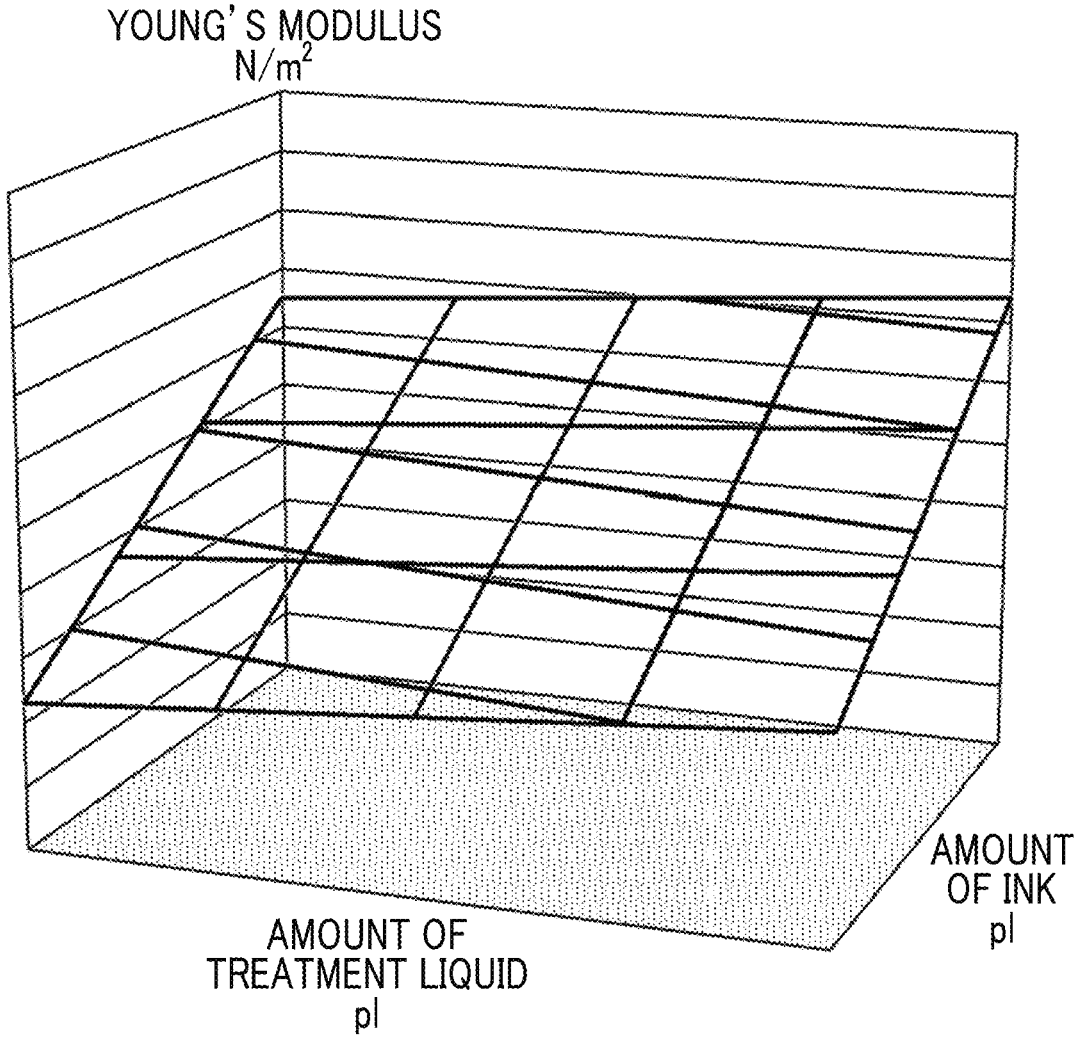
FIG. 19 is a diagram showing an example of a Young's modulus table that is applied to the image forming apparatus according to the second embodiment.

FIG. 19 is a diagram showing an example of a Young's modulus table that is applied to the image forming apparatus according to the second embodiment. A graph, which represents a Young's modulus table shown in FIG. 19, is a three-dimensional graph that has a treatment liquid-amount axis representing the amount of treatment liquid, an ink-amount axis representing the amount of ink, and a Young's modulus axis.

The unit of the amount of ink and the unit of the amount of treatment liquid are picoliter. pl shown in FIG. 19 means picoliter that is the unit of the amount of ink and the unit of the amount of treatment liquid. The unit of a Young's modulus is newton per square meter. $N/m^2$ shown in FIG. 19 means newton per square meter that is the unit of a Young's modulus.

In a case in which the amount of treatment liquid of each pixel and the amount of ink of each pixel are derived using image data, a Young's modulus of each pixel is derived using the Young's modulus table shown in FIG. 19.

Figure 20:
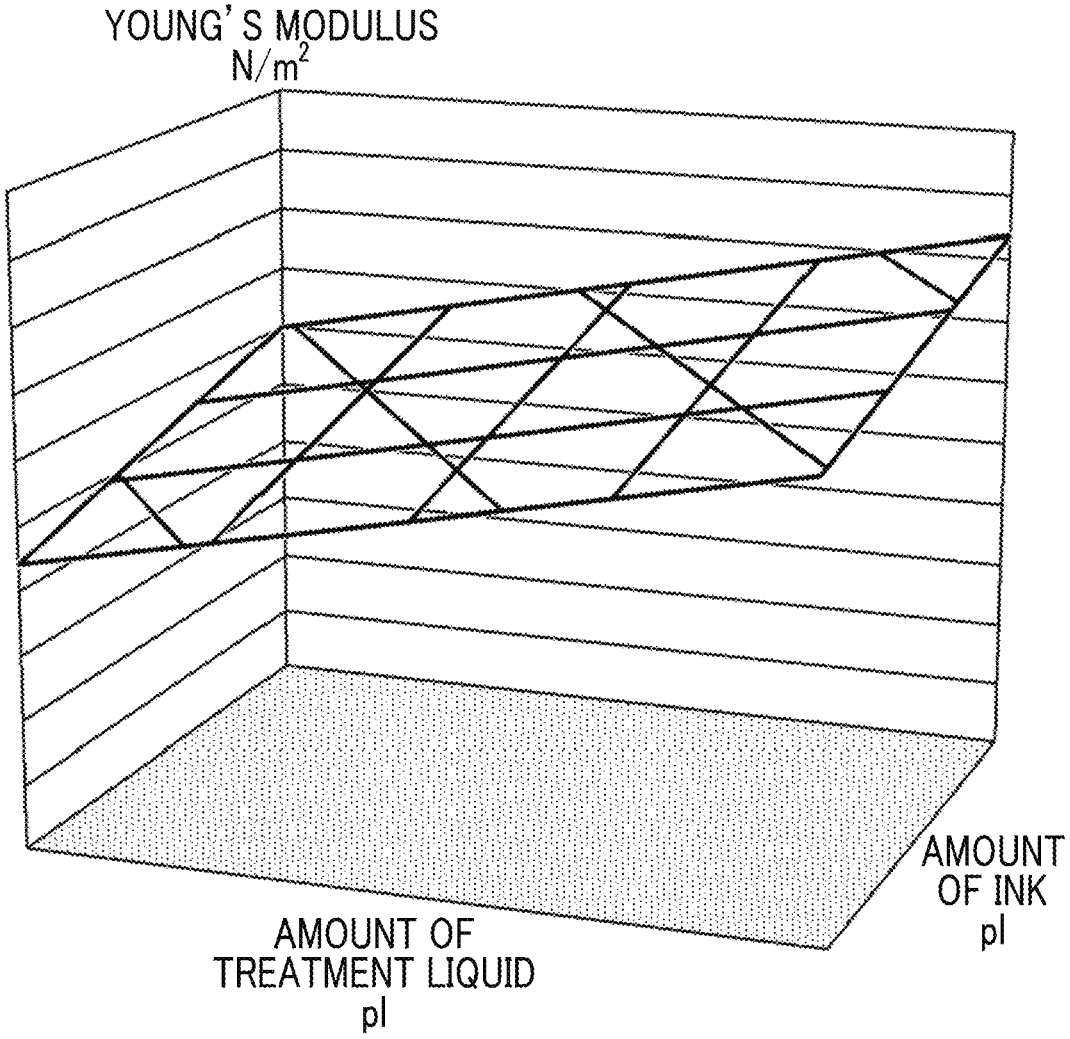
FIG. 20 is a diagram showing another example of the Young's modulus table that is applied to the image forming apparatus according to the second embodiment.

FIG. 20 is a diagram showing another example of the Young's modulus table that is applied to the image forming apparatus according to the second embodiment. The Young's modulus table shown in FIG. 20 is different from the Young's modulus table shown in FIG. 19 in terms of the type of treatment liquid and the type of ink.

The Young's modulus tables shown in FIGS. 19 and 20 are made for each type of treatment liquid and each type of ink, and are stored in the table storage section 68 shown in FIG. 18 in association with the type of treatment liquid and the type of ink.

<Description of Procedure of Image Forming Method>

Figure 21:
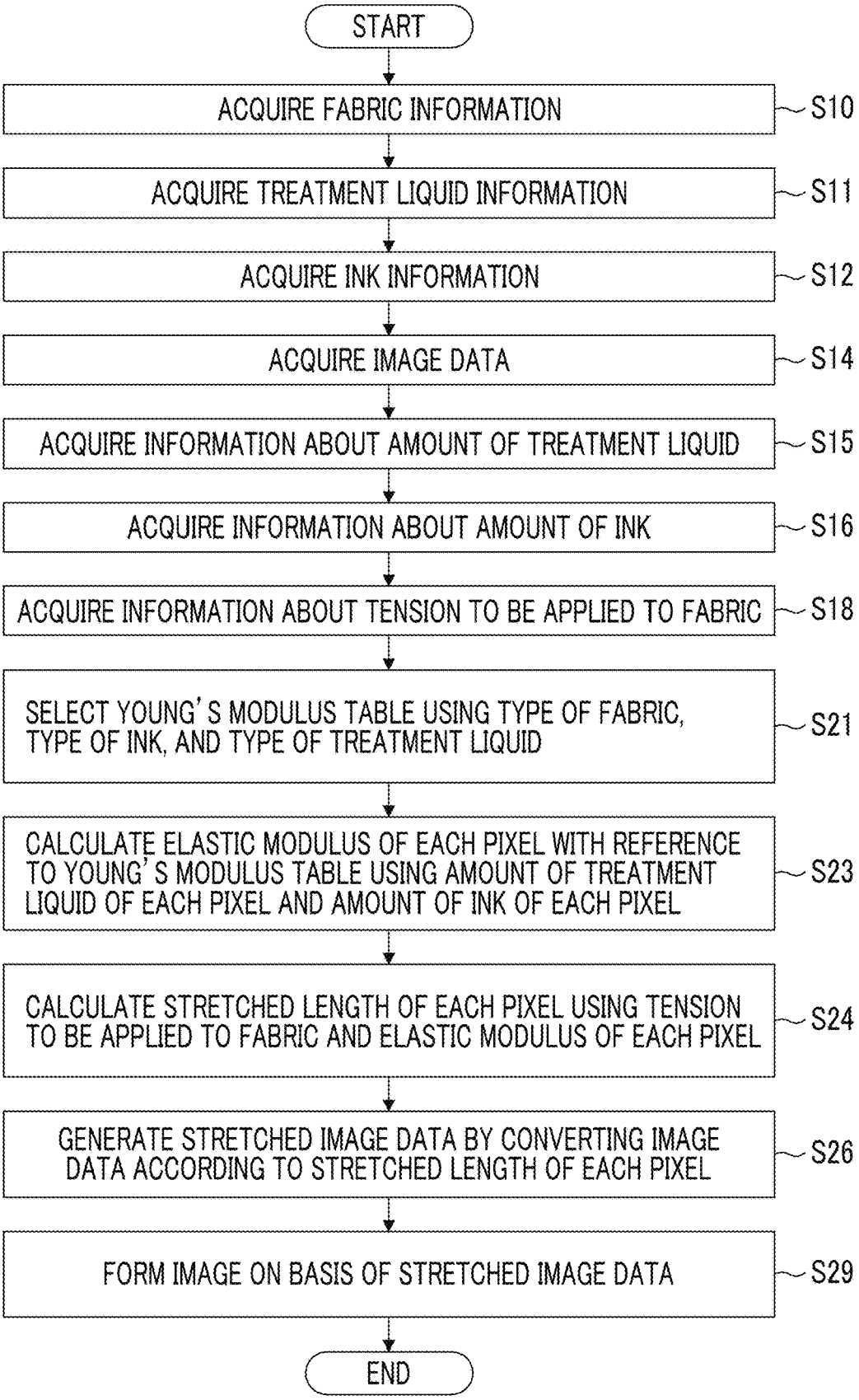
FIG. 21 is a flowchart showing the flow of an image forming method according to the second embodiment.

FIG. 21 is a flowchart showing the flow of an image forming method according to the second embodiment. The flowchart shown in FIG. 21 includes a treatment liquid-information acquisition step S11 and a treatment liquid-amount-information acquisition step S15 shown in FIG. 21 in addition to the flowchart shown in FIG. 14. The treatment liquid-amount-information acquisition step S15 is one aspect of an image forming liquid-application amount-information acquisition step.

Further, the flowchart shown in FIG. 21 includes a Young's modulus table selection step S21 of selecting a Young's modulus table using the type of fabric, the type of treatment liquid, and the type of ink instead of the Young's modulus table selection step S20 shown in FIG. 14.

Furthermore, the flowchart shown in FIG. 21 includes an elastic modulus calculation step S23 of calculating an elastic modulus of each pixel using information about the amount of treatment liquid of each pixel and information about the amount of ink of each pixel instead of the elastic modulus calculation step S22 shown in FIG. 14. The elastic modulus calculation step S23 is one aspect of an elastic modulus acquisition step.

Moreover, an image fainting step S29 includes a treatment liquid application step of applying the treatment liquid to the fabric 24 by the treatment liquid head 40S shown in FIG. 17, and a treatment liquid-drying treatment step of performing drying treatment on the fabric 24, to which the treatment liquid is applied, by the treatment liquid-drying treatment section 15B after the treatment liquid application step.

Effects of Second Embodiment

According to the ink jet recording apparatus 10A having the above-mentioned configuration and the image forming apparatus, the same effects as the effects of the first embodiment can be obtained. Further, since an image is formed on the fabric 24 to which the treatment liquid is applied, the bleeding of the image is suppressed.

[Description of Example of Ink]

Next, an example of ink to be applied to the ink jet recording apparatus 10 and the ink jet recording apparatus 10A will be described.

It is possible to prepare ink by dissolving a color material in an aqueous medium. It is possible to prepare ink by dispersing a color material in an aqueous medium. A lipophilic medium may be used instead of the aqueous medium. A dye or a pigment can be applied as the color material.

In a case in which a full-color image is to be formed, color inks, such as a magenta ink, a cyan ink, and a yellow ink, can be used and a black ink may be further used to adjust a color.

Furthermore, a color ink, such as a red ink, a green ink, an orange ink, a gray ink, a white ink, a gold ink, or a transparent color ink, may be used. Examples of an applicable color material include color materials disclosed in Paragraphs [0237] to [0240] of JP2014-005462A.

A solvent and a surfactant other than a dye may be contained in ink to give ink adequacy, textile printing adequacy, and image fastness. An aqueous medium can be applied as the solvent. Examples of a preferred solvent include water and an aqueous organic solvent.

Examples of the aqueous organic solvent include amines, monohydric alcohols, alkyl ethers of polyhydric alcohol, and the like in addition to polyhydric alcohols, such as diethylene glycol and glycerin. Further, the respective compounds that are disclosed in Paragraph [0076] of JP2002-371079A and are exemplified as examples of a water-miscible organic solvent, are suitable as the aqueous organic solvent.

It is preferable that the organic solvent content of ink is in the range of 10 percentages by mass to 60 percentages by mass based on the entire mass of ink.

Any one of a cationic surfactant, an anionic surfactant, an ampholytic surfactant, or a non-ionic surfactant may be used as the surfactant. Further, other additives may be contained in the ink as necessary without deteriorating the effect.

It is preferable that the viscosity of the ink is 30 mPa·s or less. It is preferable that the surface tension of the ink is in the range of 25 millinewtons per meter to 70 newtons per meter. Viscosity and a surface tension can be adjusted by the addition of one or more of various additives, such as a viscosity modifier, a surface tension modifier, a specific resistance adjusting agent, a coating modifier, an ultraviolet absorber, an oxidation inhibitor, a fading inhibitor, an antifungal agent, a corrosion inhibitor, a dispersant, and a surfactant.

The embodiments of the invention described above can be properly subjected to the modification, addition, and deletion of components without departing from the scope of the invention. The invention is not limited to the above-mentioned embodiments, and can be modified in various ways by those skilled in the art without departing from the scope of the invention.

EXPLANATION OF REFERENCES

10, 10A: ink jet recording apparatus
12: feed-side roll
14: transport unit
15: pretreatment section
15B: treatment liquid-drying treatment section
16: image forming unit
18: post-treatment section
20: take-up roll
22, 44: core
24: fabric
24A: portion of fabric 24 to which ink is applied
24B: distal end of fabric 24
30: transport roller
32: pair of nip rollers
34: tension roller
34A: bearing
40, 40C, 40M, 40Y, 40K: ink jet head
40A: head module
40B: jetting opening-forming surface
40S: treatment liquid head
50: system control section
52: communication section
54: host computer
56: transport control section
58: tension-application control section
60: image data acquisition section
62: image memory
64: image processing section
66: image conversion section
68: table storage section
70: tension detection unit
70A: tension detection sensor
70B: signal amplifier
72: head control section
74: post-treatment control section
76: operation unit
78: display unit
80: parameter storage section
82: program storage section
84: treatment liquid-application control section
86: treatment liquid-drying control section
100, 102, 110, 112: image
100A, 102A: first region
100B, 102B: second region
100C, 102C: third region
100D, 102D: fourth region
100E, 102E: fifth region
100F, 102F: sixth region
100G, 102G: seventh region
100H, 102H: eighth region
120: unconverted image
122, 142, 162: first pixel
124, 144, 164: second pixel
126, 146, 166: third pixel
128, 148, 168: fourth pixel
130: stretched image
132: first stretched pixel
134: second stretched pixel
136: third stretched pixel
138: fourth stretched pixel
140: converted image
149, 170: fifth pixel
150: ink
160: converted image
200: continuous body
200A, 200B: aggregate
202: finite element
204: spring element
$\{U\}$, $\{U_1\}$, $\{U_2\}$, $\{U_3\}$, $\{U_4\}$, $\{U_5\}$, $\{U_6\}$, $\{U_7\}$, $\{U_8\}$: deformation vector
$k$, $k_1$, $k_2$: elastic modulus
$p_1$, $q_1$: first calculation node
$p_2$, $q_2$: second calculation node
$p_3$, $q_3$: third calculation node
$p_4$, $q_4$: fourth calculation node
$p_5$, $q_5$: fifth calculation node
$p_6$, $q_6$: sixth calculation node
$p_7$, $q_7$: seventh calculation node
$p_8$, $q_8$: eighth calculation node
$p_n$, $q_n$, $\{P\}$, $\{Q\}$: calculation node
$E$, $E_n$: Young's modulus
$L$, $L_1$: natural length
$\delta_n$, $\delta_1$, $\delta_{2+3}$, $\delta_4$: stretched length
S10 to S29: steps of image forming apparatus

What is claimed is:

1. An image forming apparatus comprising:

an image forming unit that forms an image on a medium with image forming liquid including at least ink;

a tension applying section that applies tension to the medium;

a transport unit that allows the medium to which the tension is applied by the tension applying section and the image forming unit to be transported relative to each other;

an image data acquisition section that acquires image data;

an image forming liquid-application amount-information acquisition unit acquiring image forming liquid-application amount-information that is information about the amount of the applied image forming liquid calculated on the basis of the image data acquired by the image data acquisition section;

a tension-information acquisition unit acquiring tension information that is information about the tension applied to the medium by the tension applying section;

an elastic modulus acquisition unit that acquires an elastic modulus of the medium to which the image forming liquid is applied, the elastic modulus of the medium being calculated using the image forming liquid-application amount-information acquired by the image forming liquid-application amount-information acquisition unit;

a medium deformation amount-calculation unit that calculates the amount of deformation of the medium between a state where the tension is applied by the tension applying section and a state where the tension is not applied, using the tension information acquired by the tension-information acquisition unit and the elastic modulus of the medium acquired by the elastic modulus acquisition unit;

an image conversion section that converts the image data, which is acquired by the image data acquisition section, into converted image data, which represents a converted image to be formed on the medium in a state where the tension is applied by the tension applying section, on the basis of the amount of deformation of the medium calculated by the medium deformation amount-calculation unit; and an image formation control section that controls image formation, which is performed by the image forming unit on the medium to which the tension is applied by the tension applying section and which is transported relative to the image forming unit by the transport unit, on the basis of the converted image data.

2. The image forming apparatus according to claim 1, wherein the elastic modulus acquisition unit acquires the elastic modulus that is calculated using a Young's modulus corresponding to the amount of the applied image forming liquid acquired by the image forming liquid-application amount-information acquisition unit.

3. The image forming apparatus according to claim 2, further comprising:

a Young's modulus storage section that stores a Young's modulus for each amount of the image forming liquid to be applied to the medium.

4. The image forming apparatus according to claim 2, further comprising:

a medium feed unit that feeds a fabric as the medium, wherein the elastic modulus acquisition unit acquires the elastic modulus that is calculated using a Young's modulus of the fabric based on a type of yarn extending in a direction parallel to a direction of tension to be applied to the fabric.

5. The image forming apparatus according to claim 1, wherein the elastic modulus acquisition unit acquires an elastic modulus of each sub-region in a case in which the image data is divided into a plurality of sub-regions, the medium deformation amount-calculation unit calculates the amount of deformation for each sub-region using the elastic modulus of each sub-region that is acquired by the elastic modulus acquisition unit, and the image conversion section converts the image data, which is acquired by the image data acquisition section, for each sub-region using the amount of deformation of each sub-region that is calculated by the medium deformation amount-calculation unit.

6. The image forming apparatus according to claim 5, wherein the elastic modulus acquisition unit acquires an elastic modulus of each sub-region on the basis of the amount of the image forming liquid to be applied to each sub-region.

7. The image forming apparatus according to claim 5, wherein the elastic modulus acquisition unit acquires an elastic modulus of each sub-region on the basis of a Young's modulus of each sub-region.

8. The image forming apparatus according to claim 5, wherein the image conversion section applies a deformation vector, which represents a magnitude of the amount of deformation of each sub-region and a direction of the deformation of each sub-region, to each of calculation nodes, which are set in the sub-regions of the image data acquired by the image data acquisition section, to generate deformed image data that represents a deformed image deformed from an image represented by the image data.

9. The image forming apparatus according to claim 1, wherein the image conversion section generates deformed image data representing a deformed image, which is deformed from an image represented by the image data acquired by the image data acquisition section so as to correspond to the amount of deformation of the medium, and applies pixels of the image data to deformed pixels, which form the deformed image and are deformed from pixels serving as the minimum unit forming the image data, to generate converted image data that represents the converted image.

10. The image forming apparatus according to claim 9, wherein the image conversion section uses color information, which is an average of color information about the plurality of deformed pixels, as color information of each pixel of the converted image in a case in which color information about each pixel of the converted image includes color information about the plurality of deformed pixels of the deformed image.

11. The image forming apparatus according to claim 9, wherein the image conversion section uses color information about a pixel where an area ratio of each pixel of the converted image is high among the plurality of deformed pixels as color information about each pixel of the converted image in a case in which color information about each pixel of the converted image includes color information about the plurality of deformed pixels of the deformed image.

12. The image forming apparatus according to claim 1, wherein the tension applying section applies tension to the medium by a medium support roller that supports the medium transported by the transport unit and has a length equal to or longer than the entire length of the medium in a medium width direction which is a direction orthogonal to a relative transport direction of the medium in the transport unit, and the tension-information acquisition unit acquires information about tension, which is applied to both ends of the medium in the medium width direction, by tension detection elements that are mounted on both ends of the medium support roller in the medium width direction.

13. The image forming apparatus according to claim 1, wherein the image forming unit includes an ink jet head that jets ink to the medium.

14. The image forming apparatus according to claim 13, further comprising:

a drying treatment section that is disposed at a position on a downstream side of the image forming unit in the relative transport direction of the medium and performs drying treatment on the medium to which ink is applied by the ink jet head.

15. The image forming apparatus according to claim 13, further comprising:

a treatment liquid application unit that applies treatment liquid for aggregating ink or treatment liquid for insolubilizing ink to the medium and is disposed at a position on an upstream side of the image forming unit in the relative transport direction of the medium, wherein the image forming liquid-application amount-information acquisition unit acquires information about the amount of treatment liquid, which is applied to the medium by the treatment liquid application unit, and information about the amount of ink, which is jetted from the ink jet head, as information about the amount of the applied image forming liquid.

16. The image forming apparatus according to claim 1, wherein the image formation control section forms dots on the medium at positions, which correspond to the pixels of the converted image data, by the image forming unit.

17. An image forming method allowing a medium to which tension is applied and an image forming unit, which forms an image on the medium, to be transported relative to each other and forming an image on the medium with image forming liquid including at least ink, the image forming method comprising:

an image data acquisition step of acquiring image data;

an image forming liquid-application amount-information acquisition step of acquiring image forming liquid-application amount-information that is information about the amount of the applied image forming liquid calculated on the basis of the image data acquired in the image data acquisition step;

a tension information acquisition step of acquiring tension information that is information about the tension to be applied to the medium;

an elastic modulus acquisition step of acquiring an elastic modulus of the medium to which the image forming liquid is applied, the elastic modulus of the medium being calculated using the image forming liquid-application amount-information acquired in the image forming liquid-application amount-information acquisition step;

a medium deformation amount-calculation step of calculating the amount of deformation of the medium between a state where the tension is applied and a state where the tension is not applied, using the tension information acquired in the tension information acquisition step and the elastic modulus of the medium acquired in the elastic modulus acquisition step;

an image conversion step of converting the image data, which is acquired in the image data acquisition step, into converted image data, which represents a converted image to be formed on the medium in a state where the tension is applied, on the basis of the amount of deformation of the medium calculated in the medium deformation amount-calculation step; and an image forming step of forming an image on the medium, to which the tension is applied and which is transported relative to the image forming unit, on the basis of the converted image data.

* * * * *